US008632342B2

(12) United States Patent
Morag

(10) Patent No.: US 8,632,342 B2
(45) **Date of Patent: *Jan. 21, 2014**

(54) TRAINING SYSTEM FOR AN ARTICLE OF FOOTWEAR

(75) Inventor: Erez Morag, Lake Oswego, OR (US)

(73) Assignee: Nike, Inc., Beaverton, OR (US)

( * ) Notice: Subject to any disclaimer, the term of this patent is extended or adjusted under 35 U.S.C. 154(b) by 692 days.

This patent is subject to a terminal disclaimer.

(21) Appl. No.: 12/636,427

(22) Filed: Dec. 11, 2009

(65) Prior Publication Data

US 2010/0304346 A1 Dec. 2, 2010

Related U.S. Application Data

(63) Continuation-in-part of application No. 12/473,618, filed on May 28, 2009, now Pat. No. 8,196,321.

(51) Int. Cl.
*A63B 69/00* (2006.01)

(52) U.S. Cl.
USPC ..... 434/251

(58) Field of Classification Search
USPC ..... 434/247, 251; 473/422, 426, 452; 36/133
See application file for complete search history.

(56) References Cited

U.S. PATENT DOCUMENTS

| | | | |
|---|---|---|---|
| D15,185 | S | 8/1884 | Brooks |
| 830,324 | A | 9/1906 | Hunt |
| 950,333 | A | 2/1910 | Koch |
| 1,087,212 | A | 2/1914 | Caldwell |
| 1,184,013 | A | 5/1916 | Pierce |
| 1,361,078 | A | 12/1920 | Lynn |
| 1,469,766 | A | 10/1923 | Blair |
| 1,559,114 | A | 10/1925 | Maranville |
| D81,917 | S | 9/1930 | Burchfield |
| 2,087,945 | A | 7/1937 | Butler |
| 2,095,095 | A | 10/1937 | Howard |
| 2,185,397 | A | 1/1940 | Birchfield |
| 2,187,430 | A | 1/1940 | Olmsted et al. |
| 2,350,879 | A | 6/1944 | Daniels |
| D171,130 | S | 12/1953 | Gruner |
| 2,918,734 | A | 12/1959 | Hyde |
| 2,941,527 | A | 6/1960 | Scholl |
| 2,969,062 | A | 1/1961 | Landau |

(Continued)

FOREIGN PATENT DOCUMENTS

| | | |
|---|---|---|
| CA | 2526727 | 5/2007 |
| DE | 930798 | 7/1955 |

(Continued)

OTHER PUBLICATIONS

Invitation to Pay Additional Fees and International Search Report, mailed Nov. 19, 2010 in International Application No. PCT/US2010/036495.

(Continued)

*Primary Examiner* — Kurt Fernstrom
(74) *Attorney, Agent, or Firm* — Plumsea Law Group, LLC

(57) ABSTRACT

A training system for an article of footwear is disclosed. The training system includes a method of training an athlete to use an article of footwear with a shape correcting member to perform various types of skills including passing a ball. The method can be implemented on a computer, mobile device or as an instruction booklet. The training system provides a total training solution for an athlete that is designed to enhance specific athletic skills.

33 Claims, 11 Drawing Sheets

(56) References Cited

U.S. PATENT DOCUMENTS 3,043,026 A 7/1962 Semon
3,063,171 A 11/1962 Hollander
3,063,555 A 11/1962 Hanington
3,091,871 A 6/1963 Tronche
D201,865 S 8/1965 Bingham, Jr. et al.
3,253,591 A 5/1966 Scholl
3,325,919 A 6/1967 Robinson
3,328,901 A 7/1967 Strickland
3,341,952 A 9/1967 Dassler
3,352,034 A 11/1967 Braun
3,419,974 A 1/1969 Lange
D213,416 S 3/1969 Dittmar et al.
3,481,820 A 12/1969 Jonas
D219,503 S 12/1970 Vietas
3,548,420 A 12/1970 Spence
3,597,863 A 8/1971 Austin et al.
3,619,916 A 11/1971 Neri
3,631,614 A 1/1972 Rice
3,649,967 A 3/1972 Millman
3,656,245 A 4/1972 Wilson
3,668,793 A 6/1972 Stohr et al.
3,693,270 A 9/1972 Murray
3,703,775 A 11/1972 Gatti
3,775,874 A 12/1973 Bonneville
3,858,337 A 1/1975 Vogel
3,951,407 A 4/1976 Calacurcio
4,065,861 A 1/1978 Pelfrey
4,084,265 A 4/1978 Anfelt
4,096,649 A 6/1978 Saurwein
4,107,858 A 8/1978 Bowerman et al.
4,146,979 A 4/1979 Fabbrie
4,204,346 A * 5/1980 Fugere ..... 36/114
4,210,245 A 7/1980 Dodge
4,245,406 A 1/1981 Landay et al.
4,315,374 A 2/1982 Sneeringer
4,335,530 A 6/1982 Stubblefield
4,342,159 A 8/1982 Edwards
4,347,674 A 9/1982 George
4,375,728 A 3/1983 Dassler
4,375,729 A 3/1983 Buchanen, III
4,385,456 A 5/1983 Livernois et al.
4,392,312 A 7/1983 Crowley et al.
D271,159 S 11/1983 Muller-Feigelstock
D272,200 S 1/1984 Autry et al.
4,428,089 A * 1/1984 Dawber et al. ..... 12/142 R
D272,772 S 2/1984 Kohno
4,452,289 A 6/1984 Smith
4,454,662 A 6/1984 Stubblefield
D278,759 S 5/1985 Norton et al.
4,534,122 A 8/1985 MacPhail
4,574,498 A 3/1986 Norton et al.
4,577,625 A 3/1986 Lohati et al.
4,586,274 A 5/1986 Blair
D287,662 S 1/1987 Tonkel
4,633,600 A 1/1987 Dassler et al.
4,667,425 A 5/1987 Effler et al.
4,674,200 A 6/1987 Sing
4,689,901 A 9/1987 Ihlenburg
4,698,923 A 10/1987 Arff
4,703,445 A 10/1987 Dassler
4,715,133 A 12/1987 Hartjes et al.
4,726,126 A 2/1988 Bernhard
D294,655 S 3/1988 Heyes
D295,231 S 4/1988 Heyes
4,771,394 A 9/1988 Cavanagh
4,819,795 A 4/1989 Swaney
4,825,552 A 5/1989 Bendickson et al.
4,833,796 A 5/1989 Flemming
4,858,343 A 8/1989 Flemming
4,873,774 A 10/1989 Lafever
4,893,519 A 1/1990 Corso et al.
4,951,533 A 8/1990 Hillinger
5,025,573 A 6/1991 Giese et al.
5,056,945 A 10/1991 Klodt
D323,217 S 1/1992 Holden
5,092,347 A 3/1992 Shaffer et al.
5,174,049 A 12/1992 Flemming
5,201,126 A 4/1993 Tanel
5,203,793 A 4/1993 Lyden
5,216,827 A * 6/1993 Cohen ..... 36/134
5,221,379 A 6/1993 Nicholas
D339,459 S 9/1993 Yoshikawa et al.
5,289,647 A 3/1994 Mercer
5,299,369 A 4/1994 Goldman
D347,709 S 6/1994 Pearson
5,335,429 A 8/1994 Hansen
5,339,544 A 8/1994 Caberlotto
5,343,445 A 8/1994 Cherdak
5,351,422 A 10/1994 Fitzgerald
5,367,791 A 11/1994 Gross et al.
5,383,290 A 1/1995 Grim
5,384,973 A 1/1995 Lyden
5,392,534 A 2/1995 Grim
5,406,723 A 4/1995 Okajima
5,410,823 A 5/1995 Lyoob
5,419,014 A 5/1995 Piantedosi
5,433,437 A * 7/1995 Dudley ..... 473/446
5,452,269 A 9/1995 Cherdak
5,452,526 A 9/1995 Collins
5,461,801 A 10/1995 Anderton
5,473,827 A 12/1995 Barre et al.
5,491,015 A 2/1996 Reeves et al.
D368,156 S 3/1996 Longbottom et al.
5,500,956 A 3/1996 Schulkin et al.
D368,360 S 4/1996 Wolfe
D369,672 S 5/1996 Tanaka et al.
5,513,451 A 5/1996 Kataoka et al.
5,524,637 A 6/1996 Erickson
5,526,589 A 6/1996 Jordan
5,530,626 A 6/1996 Norment
5,555,650 A 9/1996 Longbottom et al.
5,572,739 A 11/1996 Kolada et al.
5,572,807 A 11/1996 Kelly et al.
5,592,759 A 1/1997 Cox
5,617,650 A 4/1997 Grim
5,617,653 A 4/1997 Walker et al.
5,629,186 A 5/1997 Yasukawa et al.
5,634,283 A 6/1997 Kastner
5,634,284 A 6/1997 MacPhail
5,669,833 A 9/1997 Stone
D387,892 S 12/1997 Briant
5,692,322 A 12/1997 Lombardino
D389,298 S 1/1998 Briant
5,709,954 A 1/1998 Lyden et al.
5,737,858 A 4/1998 Levy
5,740,618 A 4/1998 Minden
D394,943 S 6/1998 Campbell et al.
5,766,704 A 6/1998 Allen et al.
5,775,010 A 7/1998 Kaneko
5,806,209 A 9/1998 Crowley et al.
5,815,951 A 10/1998 Jordan
5,827,459 A 10/1998 Allen et al.
5,832,636 A 11/1998 Lyden et al.
5,878,378 A 3/1999 Brommer et al.
5,882,205 A 3/1999 Peterson
5,887,371 A 3/1999 Curley, Jr.
5,897,446 A * 4/1999 Wiseman et al. ..... 473/446
5,929,332 A 7/1999 Brown
5,939,157 A 8/1999 Allen et al.
5,946,828 A 9/1999 Jordan et al.
5,947,845 A * 9/1999 Canelas ..... 473/446
5,955,159 A 9/1999 Allen et al.
5,956,871 A 9/1999 Korsen
D415,340 S 10/1999 McMullin
5,979,083 A 11/1999 Robinson et al.
5,983,529 A 11/1999 Serna
5,985,383 A 11/1999 Allen et al.
5,987,783 A 11/1999 Allen et al.
6,016,613 A 1/2000 Campbell et al.
D421,833 S 3/2000 Fallon
6,035,559 A 3/2000 Freed et al.
6,079,127 A 6/2000 Nishimura et al.
D427,754 S 7/2000 Portaud
6,099,936 A 8/2000 Kashihara

(56) References Cited

U.S. PATENT DOCUMENTS 6,101,746 A 8/2000 Evans
6,112,433 A 9/2000 Greiner
6,125,556 A 10/2000 Peckler et al.
6,145,221 A 11/2000 Hockerson
6,161,315 A 12/2000 Dalton
D437,108 S 2/2001 Peabody
D437,989 S 2/2001 Cass
6,195,917 B1 3/2001 Dieckhaus
6,199,303 B1 3/2001 Luthi et al.
6,213,298 B1 4/2001 Nguyen
6,231,946 B1 5/2001 Brown, Jr. et al.
6,256,907 B1 7/2001 Jordan et al.
6,270,432 B1 8/2001 Matlock
6,312,361 B1 11/2001 Hayes
6,315,571 B1 11/2001 Lee
6,357,146 B1 3/2002 Wordsworth et al.
6,389,714 B1 5/2002 Mack
6,405,606 B1 6/2002 Walczyk et al.
6,408,542 B1 6/2002 Shepherd
D461,297 S 8/2002 Lancon
6,442,875 B1 9/2002 Joubert et al.
6,481,122 B2 11/2002 Brahler
D468,517 S 1/2003 Recchi et al.
6,523,282 B1 * 2/2003 Johnston ..... 36/133
6,543,158 B2 4/2003 Dieckhaus
6,550,160 B2 4/2003 Miller, II
D477,905 S 8/2003 Adams et al.
D478,714 S 8/2003 Recchi
6,618,962 B1 * 9/2003 Covatch ..... 36/72 R
6,647,549 B2 11/2003 McDevitt et al.
6,647,647 B2 11/2003 Auger et al.
6,671,981 B2 1/2004 Brooks
6,675,505 B2 1/2004 Terashima
6,698,110 B1 3/2004 Robbins
6,708,427 B2 3/2004 Sussmann et al.
6,725,574 B2 4/2004 Hokkirigawa et al.
6,739,075 B2 5/2004 Sizemore
6,754,984 B2 6/2004 Schaudt et al.
D495,122 S 8/2004 McMullin
6,808,462 B2 10/2004 Snyder et al.
6,834,446 B2 12/2004 McMullin
6,892,479 B2 5/2005 Auger et al.
6,904,707 B2 6/2005 McMullin
6,915,595 B2 7/2005 Kastner
6,915,596 B2 7/2005 Grove et al.
6,935,055 B2 8/2005 Oorei
6,941,684 B2 9/2005 Auger et al.
6,954,998 B1 10/2005 Lussier
6,968,637 B1 11/2005 Johnson
6,973,745 B2 12/2005 Mills et al.
6,973,746 B2 12/2005 Auger et al.
7,007,410 B2 3/2006 Auger et al.
7,028,419 B2 4/2006 Brooks
D525,416 S 7/2006 Auger et al.
7,143,530 B2 12/2006 Hudson et al.
7,155,846 B2 1/2007 Alfaro et al.
7,172,521 B1 * 2/2007 Novis ..... 473/446
7,181,868 B2 2/2007 Auger et al.
7,188,439 B2 3/2007 DiBenedetto et al.
7,194,826 B2 3/2007 Ungari
7,234,250 B2 6/2007 Fogarty et al.
7,241,234 B2 * 7/2007 Eite ..... 473/446
7,254,909 B2 8/2007 Ungari
7,269,916 B2 9/2007 Biancucci et al.
7,287,343 B2 10/2007 Healy
7,292,867 B2 11/2007 Werner et al.
7,329,448 B2 2/2008 Cunningham
7,355,519 B2 4/2008 Grold et al.
7,370,439 B1 5/2008 Myers
D571,092 S 6/2008 Norton
D571,542 S 6/2008 Wilken
7,386,948 B2 6/2008 Sink
D573,779 S 7/2008 Stauffer
7,401,418 B2 7/2008 Wyszynski et al.
D575,041 S 8/2008 Wilken
7,406,781 B2 8/2008 Scholz
7,409,783 B2 8/2008 Chang
D578,280 S 10/2008 Wilken
7,430,819 B2 10/2008 Auger et al.
7,441,350 B2 10/2008 Auger et al.
7,490,418 B2 2/2009 Obeydani
7,497,035 B2 * 3/2009 Kos et al. ..... 36/133
7,536,810 B2 5/2009 Jau et al.
7,559,160 B2 7/2009 Kelly
7,575,433 B2 * 8/2009 Shibata et al. ..... 434/247
7,579,946 B2 8/2009 Case, Jr.
7,581,643 B2 9/2009 Wilskey et al.
7,584,554 B2 9/2009 Fogarty et al.
7,596,891 B2 10/2009 Carnes et al.
7,650,707 B2 1/2010 Campbell et al.
D609,436 S 2/2010 Flint
7,654,013 B2 2/2010 Savoie et al.
7,665,229 B2 2/2010 Kilgore et al.
7,673,400 B2 3/2010 Brown et al.
7,685,741 B2 3/2010 Friedman
7,685,745 B2 3/2010 Kuhtz et al.
7,707,748 B2 5/2010 Campbell
7,727,608 B2 6/2010 Cunningham
7,762,009 B2 7/2010 Gerber
7,784,196 B1 8/2010 Christensen et al.
7,866,064 B2 1/2011 Gerber
D632,466 S 2/2011 Kasprzak
7,941,943 B2 5/2011 Baker et al.
7,942,784 B1 5/2011 Hyde et al.
7,984,569 B2 7/2011 Chaney et al.
7,997,007 B2 8/2011 Sanabria-Hernandez
8,043,173 B2 10/2011 Menalagha et al.
8,079,160 B2 12/2011 Baucom et al.
8,122,617 B1 2/2012 Dixon et al.
8,196,321 B2 6/2012 Baker et al.
8,196,322 B2 6/2012 Atsumi et al.
8,246,494 B2 8/2012 Stephenson
8,251,207 B2 8/2012 Baker et al.
8,256,145 B2 9/2012 Baucom et al.
8,257,228 B2 9/2012 Quatrochi et al.
8,262,515 B2 9/2012 Morris
8,286,619 B2 10/2012 Mihaljevic
2001/0022039 A1 9/2001 Krajcir
2002/0017036 A1 2/2002 Berger et al.
2002/0029496 A1 3/2002 Morle
2002/0078603 A1 6/2002 Schmitt, Jr.
2002/0100190 A1 8/2002 Pellerin
2002/0178619 A1 12/2002 Schaudt et al.
2003/0033731 A1 2/2003 Sizemore
2003/0188458 A1 10/2003 Kelly
2004/0000075 A1 1/2004 Auger et al.
2004/0035024 A1 2/2004 Kao
2004/0046692 A1 3/2004 Robson et al.
2004/0088888 A1 5/2004 Johnston
2004/0187356 A1 9/2004 Patton
2004/0250451 A1 12/2004 McMullin
2005/0016023 A1 1/2005 Burris
2005/0016029 A1 1/2005 Auger et al.
2005/0072026 A1 4/2005 Sink
2005/0097783 A1 5/2005 Mills et al.
2005/0108898 A1 5/2005 Jeppesen et al.
2005/0120593 A1 6/2005 Mason
2005/0144812 A1 * 7/2005 Wheeler ..... 36/133
2005/0217149 A1 10/2005 Ho
2005/0221919 A1 * 10/2005 Eite ..... 473/446
2005/0257405 A1 11/2005 Kilgore
2005/0268490 A1 12/2005 Foxen
2006/0016101 A1 1/2006 Ungari
2006/0021254 A1 2/2006 Jones
2006/0021255 A1 2/2006 Auger et al.
2006/0026528 A1 2/2006 Paulsen et al.
2006/0042124 A1 3/2006 Mills et al.
2006/0130372 A1 6/2006 Auger et al.
2006/0218821 A1 10/2006 Hatzilias
2006/0242863 A1 11/2006 Patmore
2007/0039209 A1 2/2007 White et al.
2007/0199211 A1 8/2007 Campbell
2007/0199213 A1 8/2007 Campbell et al.
2007/0227047 A1 * 10/2007 Zaza ..... 36/133

(56) References Cited

U.S. PATENT DOCUMENTS

| | | | | |
|---|---|---|---|---|
| 2007/0261271 | A1 | 11/2007 | Krouse | |
| 2007/0266597 | A1 | 11/2007 | Jones | |
| 2008/0009275 | A1 | 1/2008 | Werner et al. | |
| 2008/0010863 | A1 | 1/2008 | Auger et al. | |
| 2008/0059064 | A1 | 3/2008 | Werner et al. | |
| 2008/0066348 | A1 | 3/2008 | O'Brien et al. | |
| 2008/0098624 | A1 | 5/2008 | Goldman | |
| 2008/0127520 | A1 | 6/2008 | Luedecke et al. | |
| 2008/0196276 | A1 | 8/2008 | McMullin | |
| 2008/0214360 | A1 | 9/2008 | Stirling et al. | |
| 2008/0216352 | A1 | 9/2008 | Baucom et al. | |
| 2008/0218310 | A1 | 9/2008 | Alten et al. | |
| 2008/0293023 | A1* | 11/2008 | Diehl et al. | 434/248 |
| 2008/0319661 | A1 | 12/2008 | Werner et al. | |
| 2009/0019732 | A1 | 1/2009 | Sussmann | |
| 2009/0047645 | A1* | 2/2009 | Dibenedetto et al. | 434/258 |
| 2009/0048044 | A1 | 2/2009 | Oleson et al. | |
| 2009/0048070 | A1 | 2/2009 | Vincent et al. | |
| 2009/0056169 | A1 | 3/2009 | Robinson, Jr. et al. | |
| 2009/0056172 | A1 | 3/2009 | Cho | |
| 2009/0077832 | A1* | 3/2009 | Flint | 36/133 |
| 2009/0100711 | A1 | 4/2009 | Engel | |
| 2009/0100716 | A1 | 4/2009 | Gerber | |
| 2009/0100718 | A1 | 4/2009 | Gerber | |
| 2009/0113758 | A1 | 5/2009 | Nishiwaki et al. | |
| 2009/0113766 | A1 | 5/2009 | Hooper | |
| 2009/0124434 | A1* | 5/2009 | Abboud | 473/446 |
| 2009/0126230 | A1 | 5/2009 | McDonald et al. | |
| 2009/0223088 | A1 | 9/2009 | Krikorian et al. | |
| 2009/0241370 | A1 | 10/2009 | Kimura | |
| 2009/0241377 | A1 | 10/2009 | Kita et al. | |
| 2009/0272008 | A1 | 11/2009 | Nomi et al. | |
| 2009/0284368 | A1 | 11/2009 | Case, Jr. | |
| 2009/0293315 | A1 | 12/2009 | Auger et al. | |
| 2009/0307933 | A1 | 12/2009 | Leach | |
| 2010/0050471 | A1 | 3/2010 | Kim | |
| 2010/0077635 | A1 | 4/2010 | Baucom et al. | |
| 2010/0083541 | A1 | 4/2010 | Baucom et al. | |
| 2010/0126044 | A1 | 5/2010 | Davis | |
| 2010/0199523 | A1 | 8/2010 | Mayden et al. | |
| 2010/0212190 | A1 | 8/2010 | Schmid | |
| 2010/0229427 | A1 | 9/2010 | Campbell et al. | |
| 2010/0251578 | A1 | 10/2010 | Auger et al. | |
| 2010/0275463 | A1 | 11/2010 | Gallagher | |
| 2010/0299961 | A1 | 12/2010 | Baker et al. | |
| 2010/0299967 | A1 | 12/2010 | Atsumi et al. | |
| 2010/0304346 | A1 | 12/2010 | Morag | |
| 2010/0313447 | A1 | 12/2010 | Becker et al. | |
| 2010/0331122 | A1 | 12/2010 | Morag | |
| 2011/0045926 | A1 | 2/2011 | Morag et al. | |
| 2011/0047830 | A1 | 3/2011 | Francello et al. | |
| 2011/0078922 | A1 | 4/2011 | Cavaliere et al. | |
| 2011/0078927 | A1 | 4/2011 | Baker | |
| 2011/0088287 | A1 | 4/2011 | Auger et al. | |
| 2011/0126426 | A1 | 6/2011 | Amark | |
| 2011/0167676 | A1 | 7/2011 | Benz et al. | |
| 2011/0197475 | A1 | 8/2011 | Weidl et al. | |
| 2011/0197478 | A1 | 8/2011 | Baker | |
| 2011/0203136 | A1 | 8/2011 | Auger | |
| 2012/0052987 | A1 | 3/2012 | Goodman | |
| 2012/0107781 | A1 | 5/2012 | Morag et al. | |
| 2012/0180343 | A1 | 7/2012 | Auger et al. | |
| 2012/0277891 | A1 | 11/2012 | Aragones et al. | |

FOREIGN PATENT DOCUMENTS

| | | |
|---|---|---|
| DE | 1809860 | 4/1960 |
| DE | 2721410 | 11/1978 |
| DE | 3046811 | 7/1982 |
| DE | 3135347 | 3/1983 |
| DE | 3245182 | 5/1983 |
| DE | 3600525 | 10/1987 |
| DE | 3644812 | 6/1988 |
| DE | 3706069 | 9/1988 |
| DE | 4417563 | 11/1995 |
| DE | 19817579 | 10/1999 |
| EP | 0115663 | 8/1984 |
| EP | 115663 | 8/1984 |
| EP | 0123550 | 10/1984 |
| EP | 123550 | 10/1984 |
| EP | 0223700 | 5/1987 |
| EP | 340053 | 11/1989 |
| EP | 0723745 | 7/1996 |
| EP | 1025771 | 8/2000 |
| EP | 1430801 | 6/2004 |
| EP | 1714571 | 10/2006 |
| EP | 1839511 | 10/2007 |
| EP | 2057913 | 5/2009 |
| EP | 2499928 | 9/2012 |
| FR | 1554061 | 1/1969 |
| FR | 2567004 | 1/1986 |
| FR | 2818876 | 7/2002 |
| GB | 1329314 | 9/1973 |
| GB | 2020161 | 11/1979 |
| GB | 2113971 | 8/1983 |
| GB | 2256784 | 12/1992 |
| GB | 2377616 | 1/2003 |
| GB | 2413052 | 10/2005 |
| GB | 2425706 | 11/2006 |
| JP | 9209206 | 8/1997 |
| JP | 9253266 | 9/1997 |
| JP | 10000105 | 1/1998 |
| JP | 10066605 | 3/1998 |
| JP | 63256704 | 10/1998 |
| JP | 11276204 | 10/1999 |
| JP | 2002272506 | 9/2002 |
| JP | 2002306207 | 10/2002 |
| JP | 2004024811 | 1/2004 |
| JP | 2005185303 | 7/2005 |
| JP | 2005304653 | 11/2005 |
| TW | 540323 | 7/2003 |
| TW | 540323 U | 7/2003 |
| TW | M267886 | 6/2005 |
| TW | M267886 U | 6/2005 |
| WO | 0053047 | 9/2000 |
| WO | 03045182 | 6/2003 |
| WO | 03071893 | 9/2003 |
| WO | WO 03071893 | 9/2003 |
| WO | 2006103619 | 10/2006 |
| WO | 2008069751 | 6/2008 |
| WO | 2008128712 | 10/2008 |
| WO | 2009110822 | 9/2009 |
| WO | WO 2009110822 | 9/2009 |
| WO | 2010036988 | 4/2010 |
| WO | WO 2010036988 | 4/2010 |
| WO | 2010057207 | 5/2010 |
| WO | 2012150971 | 11/2012 |

OTHER PUBLICATIONS

International Search Report and Written Opinion of The International Searching Authority mailed Jan. 18, 2011 in International Application No. PCT/US2010/036495.

International Preliminary Report on Patentability (including Written Opinion of the ISA) mailed Dec. 8, 2011 in International Application No. PCT/US2010/036495.

International Search Report and Written Opinion mailed Mar. 15, 2011 in International Application No. PCT/US2010/034821.

International Preliminary Report on Patentability (including Written Opinion of the ISA) mailed Dec. 8, 2011 in International Application No. PCT/US2010/034821.

Pending U.S. Appl. No. 13/582,252, filed Oct. 20, 2009.

Pending U.S. Appl. No. 13/234,180, filed Sep. 16, 2011.

International Search Report and Written Opinion mailed Jun. 7, 2010 in PCT Application No. PCT/US2009/058522.

International Search Report and Written Opinion mailed May 24, 2010 in PCT Application No. PCT/US2010/029640.

U.S. Appl. No. 12/824,753, filed Jun. 28, 2010.

U.S. Appl. No. 12/824,768, filed Jun. 28, 2010.

International Search Report and Written Opinion for PCT/US2011/045356 dated Dec. 16, 2011.

(56) References Cited

OTHER PUBLICATIONS

International Search Report and Written Opinion for PCT/US2011/022841 dated Apr. 15, 2011.
International Search Report and Written Opinion for PCT/US2011/022848 dated Jun. 20, 2011.
Aug. 12, 2010, Icebug Web Page (date based on information from Internet Archive).
Dec. 23, 2008, Icebug Web Page (date based on information from Internet Archive).
International Search Report for PCT/US2010/050637 dated Jan. 14, 2011.
Partial Search Report for PCT/US2009/058522 dated Mar. 4, 2010.
U.S. Appl. No. 12/239,190, filed Sep. 26, 2008.
U.S. Appl. No. 12/566,792, filed Sep. 25, 2009.
U.S. Appl. No. 12/711,107, filed Feb. 23, 2010.
U.S. Appl. No. 12/708,411, filed Feb. 18, 2010.
U.S. Appl. No. 12/572,154, filed Oct. 1, 2009.
International Search Report for PCT/US2009/058522 dated Feb. 17, 2010.
International Search Report for PCT/US2010/029640 dated May 17, 2010.
Pending U.S. Appl. No. 13/561,608, filed Jul. 30, 2012.
Pending U.S. Appl. No. 13/561,557, filed Jul. 30, 2012.
Invitation to Pay Additional Fees and, Where Applicable, Protest Fee mailed Jan. 7, 2013 in International Application No. PCT/US2012/052968.
Invitation to Pay Additional Fees and, Where Applicable, Protest Fee mailed Jan. 8, 2013 in International Application No. PCT/US2012/052970.
Invitation to Pay Additional Fees and, Where Applicable, Protest Fee mailed Jan. 7, 2013 in International Application No. PCT/US2012/052965.
International Search Report and Written Opinion mailed Jan. 22, 2013 in International Application No. PCT/US2012/052972.
Invitation to Pay Additional Fees and, Where Applicable, Protest Fee mailed Feb. 8, 2013 in International Application No. PCT/US2012/052963.
International Search Report and Written Opinion mailed Mar. 8, 2013 in International Application No. PCT/US2012/052965.
International Search Report and Written Opinion mailed Mar. 8, 2013 in International Application No. PCT/US2012/052968.
International Search Report and Written Opinion mailed Mar. 8, 2013 in International Application No. PCT/US2012/052970.
Voluntary Amendments filed Sep. 20, 2012 in Chinese Patent Application No. 201080033231.2 with English-language translation.
Voluntary Amendments filed Nov. 22, 2012 in Chinese Patent Application No. 201080033236.5 with English-language translation.
Office Action mailed Jan. 22, 2013 in U.S. Appl. No. 12/824,753.
Office Action mailed Dec. 6, 2012 in U.S. Appl. No. 12/916,958.
Response to Office Action filed Mar. 6, 2013 in U.S. Appl. No. 12/916,958.
Office Action mailed Jan. 22, 2013 in U.S. Appl. No. 12/824,768.
Office Action mailed Sep. 26, 2012 in U.S. Appl. No. 12/752,318.
Response to Office Action filed Dec. 27, 2012 in U.S. Appl. No. 12/752,318.
Notice of Allowance mailed Feb. 7, 2013 in U.S. Appl. No. 12/752,318.
Voluntary Amendment filed Sep. 20, 2012 in Chinese Application No. 201080033231.2 and English translation thereof.
Voluntary Amendment filed Nov. 22, 2012 in Chinese Application No. 201080033236.5 and English translation thereof.
Response to Office Action filed Apr. 22, 2013 in U.S. Appl. No. 12/824,753.
Response to Office Action filed Apr. 22, 2013 in U.S. Appl. No. 12/824,768.
Notice of Allowance mailed Jul. 12, 2013 in U.S. Appl. No. 12/824,753.
Notice of Allowance mailed May 10, 2013 in U.S. Appl. No. 12/916,958.
Notice of Allowance mailed Aug. 22, 2013 in U.S. Appl. No. 12/824,768.
Response to Office Action filed Sep. 12, 2012 in U.S. Appl. No. 12/582,252.
Notice of Allowance mailed Sep. 20, 2012 in U.S. Appl. No. 12/582,252.
International Search Report and Written Opinion mailed Jun. 13, 2012 in International Application No. PCT/US2012/021663.
Office Action mailed Jun. 13, 2012 in U.S. Appl. No. 12/582,252.
Pending U.S. Appl. No. 13/234,182, filed Sep. 16, 2011.
Pending U.S. Appl. No. 13/234,183, filed Sep. 16, 2011.
Pending U.S. Appl. No. 13/234,185, filed Sep. 16, 2011.
Pending U.S. Appl. No. 13/009,549, filed Jan. 19, 2011.
Pending U.S. Appl. No. 13/234,244, filed Sep. 16, 2011.
Pending U.S. Appl. No. 12/582,252, filed Oct. 20, 2009.
Pending U.S. Appl. No. 13/234,233, filed Sep. 16, 2011.

* cited by examiner

TRAINING SYSTEM FOR AN ARTICLE OF FOOTWEAR

CROSS-REFERENCE TO RELATED APPLICATION

This application is a continuation-in-part of U.S. Pat. No. 8,196,321 currently U.S. patent application Ser. No. 12/473,618, filed May 28, 2009, which is entitled "Article of footwear with a shape correction member," and hereby referred to as "the shape correction case", the entirety of which is incorporated herein by reference.

BACKGROUND

The present invention relates generally to an article of footwear, and in particular to a training system for an article of footwear.

Articles of footwear configured to enhance comfort and fit of an article have previously been proposed. Grim (U.S. Pat. No. 5,617,650) is directed to a vacuum formed conformable shoe. Grim teaches shoes that are provided with soles and/or upper portions which conform to the configuration of the user's feet by the use of vacuum formable bladders in the sole of the shoes and/or in the sides of the upper portions of the shoes. The shoe includes two bladder zones. The bladders are filled with air using a pump, which operates as a wearer walks or runs.

The related art lacks provisions for training an athlete to use articles that enhance comfort and fit.

SUMMARY

In one aspect, the invention provides a method of training a user wearing an article of footwear, comprising the steps of: providing training instructions to the user; instructing the user to move along a predetermined path; instructing the user to pass a ball by contacting the ball with a portion of an upper of the article of footwear including a shape correcting member, the shape correcting member being disposed in an inner portion of the upper and the shape correcting member including a central hole configured to receive a bony protrusion of a foot; and wherein the shape correcting member presents a flat surface for the upper in the portion adjacent to the bony protrusion.

In another aspect, the invention provides a method of training a user wearing an article of footwear, comprising the steps of: providing training instructions to the user; instructing the user to maintain a ball within a control zone, the control zone having predetermined boundaries; instructing the user to pass the ball outside of the control zone by contacting the ball with a portion of an upper of the article of footwear including a shape correcting member, the shape correcting member including an inner surface associated with a portion of a foot and an outer surface disposed opposite of the inner surface, the inner surface being pre-shaped to fit to the contours of the portion of the foot; and wherein the outer surface is a substantially smooth surface.

In another aspect, the invention provides a method of using an article of footwear, comprising the steps of: receiving training instructions; moving along a predetermined path, the predetermined path being determined from the training instructions; passing a ball by contacting the ball with a portion of an upper of the article of footwear including a shape correcting member, the shape correcting member including an inner surface associated with a portion of a foot and an outer surface disposed opposite of the inner surface, the inner surface being pre-shaped to fit to the contours of the portion of the foot; and wherein the outer surface is a substantially smooth surface.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
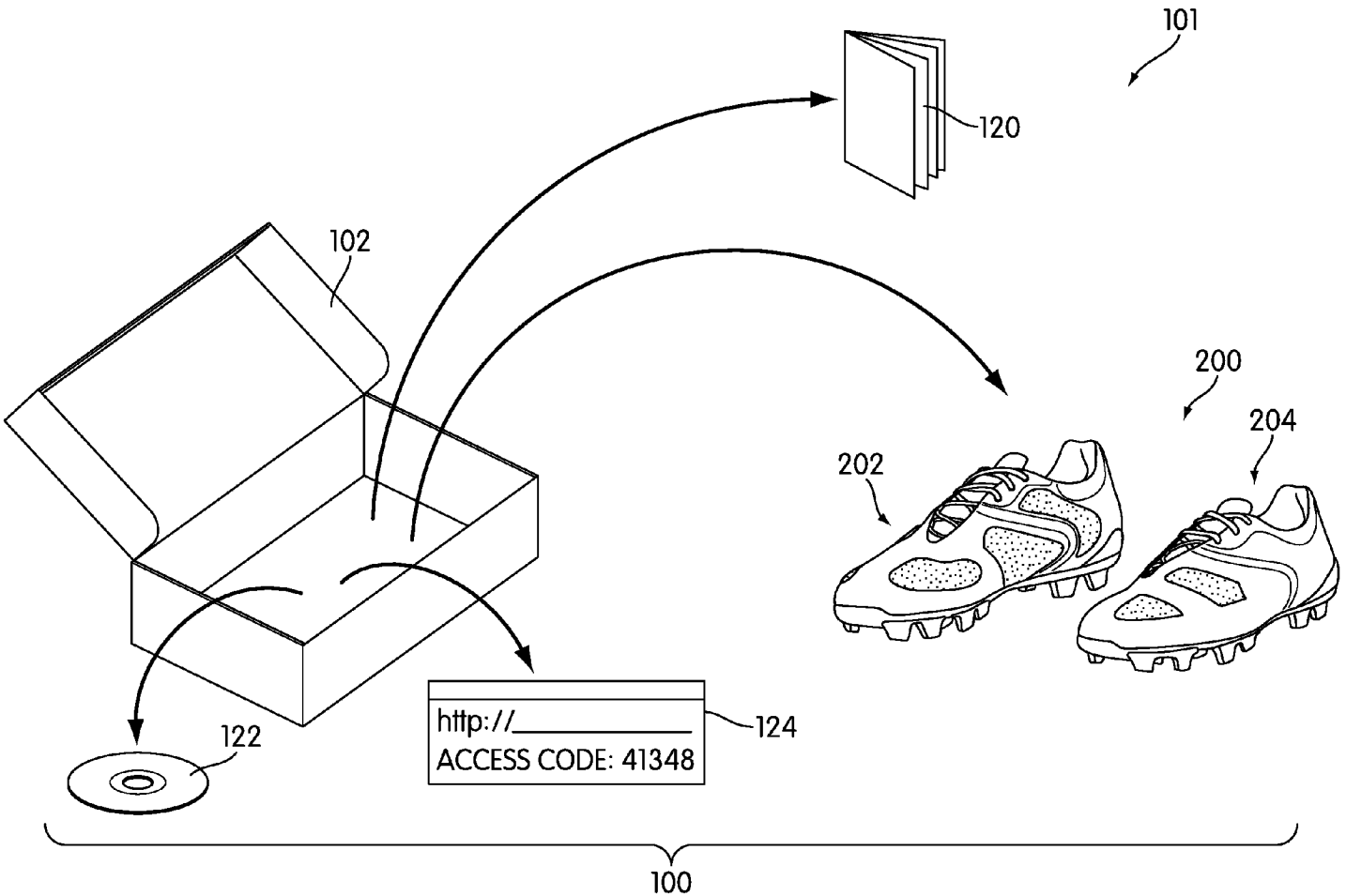
FIG. 1 is a schematic view of an embodiment of a training kit for use in training an athlete to use an article of footwear.

FIG. 1 illustrates and embodiment of training system 101. Training system 101 can be used with any type of footwear. In addition, the principles discussed throughout this detailed description may not be limited in use to footwear. Similar principles could be applied to customization kits for various different types of apparel as well. In an exemplary embodiment, training system 101 may provide a total training solution for an athlete. This total training solution may comprise a combination of footwear and training instructions that is designed to enhance specific athletic skills.

In some embodiments, some components of training system 101 may take the form of training kit 100, also referred to hereafter as kit 100. Kit 100 may comprise one or more items that are packaged together, or otherwise sold or purchased together. It will be understood that in other embodiments, however, components of training system 101 may not be packaged together as a kit but may be sold and/or purchased separately.

In some embodiments, training kit 100 may be used by a customer at home. For example, in some cases, a customer could purchase training kit 100 at a retail location and bring kit 100 home. In other cases, kit 100 may be shipped to an address associated with the customer. In other embodiments, kit 100 could be used at any other location, such as a retail store or a kiosk.

Kit 100 may include container 102. Container 102 can be any type of container configured to store at least one article of footwear. In some cases, container 102 may be a box. In an exemplary embodiment, container 102 may be a shoebox that is configured to store a pair of footwear.

In one embodiment, kit 100 can include pair of footwear 200. Pair of footwear 200 may further comprise first article of footwear 202 and second article of footwear 204. Generally, articles of footwear associated with kit 100 can be any type of footwear. For clarity, the following detailed description discusses articles of footwear in the form of sports shoes, but it should be noted that in other embodiments any other type of footwear could be used including, but not limited to: hiking boots, soccer shoes, football shoes, sneakers, rugby shoes, basketball shoes, baseball shoes as well as other kinds of shoes. Articles of footwear associated with kit 100 may also take the form of any non-athletic shoe, including, but not limited to: dress shoes, loafers, sandals, and boots. An individual skilled in the relevant art will appreciate, therefore, that the concepts disclosed herein apply to a wide variety of footwear styles, in addition to the specific style discussed in the following material and depicted in the accompanying figures.

First article of footwear 202 and second article of footwear 204 may be oriented for a right foot and a left foot, respectively. For purposes of clarity, the following detailed description discusses first article of footwear 202, but it will be understood that each of the features discussed for first article of footwear 202 could also apply to second article of footwear 204. For purposes of convenience, first article of footwear 202 may also be referred to as article 202 throughout the remainder of this detailed description.

Kit 100 can also include provisions for training an athlete to use first article of footwear 202 and second article of footwear 204. The term "athlete" is intended to include both professional athletes and amateur athletes. Generally, an athlete may be any person wishing to take part in an athletic training activity. Any user of pair of footwear 200 may be referred to as an "athlete" throughout this detailed description and in the claims. Furthermore, the terms "athlete" and "user" may be used interchangeably throughout the detailed description and in the claims.

In some embodiments, kit 100 can include provisions for training an athlete to use an article of footwear to accomplish various skills that are important in one or more sports, such as football, soccer, tennis, or any other sport of activity. For example, in embodiments where kit 100 includes a pair of soccer shoes, kit 100 may further include training instructions that may train an athlete to use the pair of soccer shoes to kick, pass, dribble, trap, or perform other maneuvers or skills with a ball. Furthermore, in an exemplary embodiment, kit 100 can include training instructions that may be used by an athlete to learn to use specific features of one or more articles of footwear for accomplishing various skills such as kicking or passing.

In the current embodiment, kit 100 may include one or more sets of training instructions. The term "training instructions" as used throughout this detailed description and in the claims refers to any instructions that can be used to train an athlete or user. Training instructions can be provided as written instructions, pictures, videos, audible instructions as well as any combination thereof.

In different embodiments, training instructions could be provided in different formats. In some cases, training instructions could be provided as paper based or printed instructions. In other cases, training instructions could be provided on various types of removable media. The term "removable media" refers to any media that can be inserted into a media reading device such as a computer, optical media player (including DVD players, CD players and Blu-ray players) or any other type of media reading device. Examples of removable media include, but are not limited to: computer disks, CDs, CD-ROMs, DVDs, Blu-rays discs, HD-DVD discs, removable hard drives, digital memory cards and flash drives as well as any other types of media that can be used with a media reading device.

In the current embodiment, kit 100 may include instruction booklet 120. Instruction booklet 120 may be a set of printed instructions that is packaged with pair of footwear 200 in container 102. In addition, kit 100 may include digital based instructions in the form of removable media 122. Removable media 122 may be inserted into a media reading device, including a computer or dedicated media player, for purposes of accessing training instructions. In an exemplary embodiment, removable media 122 may take the form of a DVD or CD-ROM. In other embodiments, kit 100 could be provided with information for accessing training instructions remotely. For example, in the current embodiment, kit 100 may include card 124. In some cases, card 124 may provide information for remotely accessing one or more sets of training instructions on the web. In particular, in one embodiment, card 124 may include an address for a website as well as any necessary access information such as a user ID and/or user password. In still other embodiments, card 124 could provide a user with information for obtaining one or more software programs that may include training instructions. For example, in one embodiment, card 124 could include information for downloading a software based training application on a computer or mobile device.

It will be understood that some of the provisions included in kit 100 are optional. In particular, in some cases a kit may only include one form of training instructions. Furthermore, in other embodiments training instructions can be provided in any other format.

Figure 2:
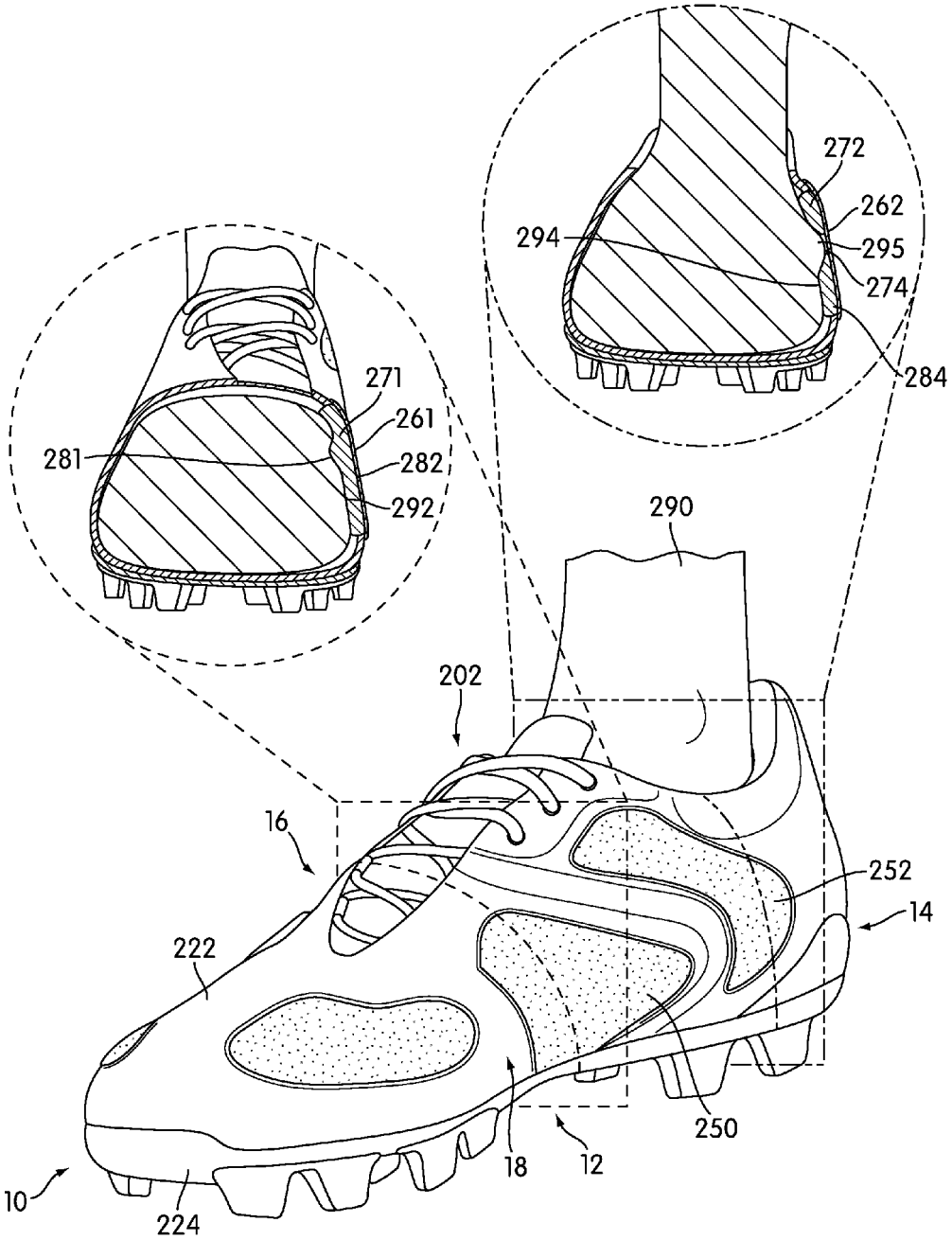
FIG. 2 is an isometric view of an embodiment of an article of footwear including shape correcting members.

FIG. 2 illustrates an isometric view of an embodiment of first article of footwear 202, hereby also referred to as article 202. In this case, foot 290 has been inserted into article 202. Referring to FIG. 2, for purposes of reference, article 202 may be divided into forefoot portion 10, midfoot portion 12 and heel portion 14. Forefoot portion 10 may be generally associated with the toes and joints connecting the metatarsals with the phalanges. Midfoot portion 12 may be generally associated with the arch of a foot. Midfoot portion 12 may also be associated with portions of the metatarsals. Likewise, heel portion 14 may be generally associated with the heel of a foot, including the calcaneus bone. In addition, article 202 may include lateral side 16 and medial side 18. In particular, lateral side 16 and medial side 18 may be opposing sides of article 202. Furthermore, both lateral side 16 and medial side 18 may extend through forefoot portion 10, midfoot portion 12 and heel portion 14.

It will be understood that forefoot portion 10, midfoot portion 12 and heel portion 14 are only intended for purposes of description and are not intended to demarcate precise regions of article 202. Likewise, lateral side 16 and medial side 18 are intended to represent generally two sides of an article, rather than precisely demarcating article 202 into two halves. In addition, forefoot portion 10, midfoot portion 12 and heel portion 14, as well as lateral side 16 and medial side 18, can also be applied to individual components of an article, such as a sole structure and/or an upper.

For consistency and convenience, directional adjectives are employed throughout this detailed description corresponding to the illustrated embodiments. The term "longitudinal" as used throughout this detailed description and in the claims refers to a direction extending a length or major axis of an article. In some cases, the longitudinal direction may extend from a forefoot portion to a heel portion of the article. Also, the term "lateral" as used throughout this detailed description and in the claims refers to a direction extending a width or minor axis of an article. In other words, the lateral direction may extend between a medial side and a lateral side of an article. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. In addition, the term "proximal" refers to a portion of a footwear component that is closer to a portion of a foot when an article of footwear is worn. Likewise, the term "distal" refers to a portion of a footwear component that is further from a portion of a foot when an article of footwear is worn. It will be understood that each of these directional adjectives may be applied to individual components of an article, such as an upper and/or a sole structure.

Article 202 can include upper 222. Generally, upper 222 may be any type of upper. In particular, upper 222 may have any design, shape, size and/or color. For example, in embodiments where article 202 is a basketball shoe, upper 222 could be a high top upper that is shaped to provide high support on an ankle. In embodiments where article 202 is a running shoe, upper 222 could be a low top upper.

Article 202 can include sole structure 224. In some embodiments, sole structure 224 may be configured to provide traction for article 202. In addition to providing traction, sole structure 224 may attenuate ground reaction forces when compressed between the foot and the ground during walking, running or other ambulatory activities. The configuration of sole structure 224 may vary significantly in different embodiments to include a variety of conventional or non-conventional structures. In some cases, the configuration of sole structure 224 can be configured according to one or more types of ground surfaces on which sole structure 224 may be used. Examples of ground surfaces include, but are not limited to: natural turf, synthetic turf, dirt, as well as other surfaces.

Sole structure 224 extends between the foot and the ground when article 202 is worn. In different embodiments, sole structure 224 may include different components. For example, sole structure 224 may include an outsole, a midsole, and/or an insole. In some cases, one or more of these components may be optional.

In some embodiments, an article may include shape correcting provisions so that the article presents a smooth surface in an area adjacent to a bony protrusion of a foot. The term "smooth surface," as used throughout this detailed description and in the claims, refers to a surface having an approximately constant curvature and without any recesses, protrusions or other types of local deformations. In some cases, a smooth surface may be curved. For example, a smooth surface of an article adjacent to a toe portion of an article may be rounded. In other cases, a smooth surface may be substantially flat. For example, a medial portion of an article may include a smooth surface that is substantially flat.

In some embodiments, an article may include a shape correcting member to present a smooth surface in an area adjacent to a bony protrusion of a foot. In particular, an outer surface of a shape correcting member may comprise a substantially smooth surface. In addition, an inner surface of the shape correcting member may be configured to receive a bony protrusion of a foot. With this arrangement, the shape correcting member may present a smooth surface adjacent to a bony protrusion of a foot.

Examples of different types of shape correcting members are disclosed in the shape correction case. In some cases, shape correcting members can be used to smooth out the irregular surface of the top of a foot at the toes. In other cases, shape correcting members can be used to smooth out bony protrusions that occur on the sides of a foot. In still other cases, shape correcting members can be used to smooth out any other kinds of irregularities in the geometry of a foot in order to provide a substantially smooth surface for contacting a ball.

In some embodiments, article 202 can include first shape correcting portion 250 and second shape correcting portion 252. First shape correcting portion 250 may be disposed on medial side 18 of upper 222. In some cases, first shape correcting portion 250 may be disposed in midfoot portion 12. In other words, in some cases, first shape correcting portion 250 may be generally associated with a medial side of a foot arch. In other cases, however, first shape correcting portion 250 may be associated with any other portion of upper 222.

In some cases, second shape correcting portion 252 may also be disposed on medial side 18 of upper 222. In some cases, second shape correcting portion 252 may be disposed closer to heel portion 14 than first shape correcting portion 250. In particular, in some cases, second shape correcting portion 252 may be disposed closer to an ankle of a foot than first shape correcting portion 250. In other embodiments, however, second shape correcting portion 252 could be disposed on any other portion of upper 222.

In some embodiments, a shape correcting portion can comprise a layered structure. In the current embodiment, first shape correcting portion 250 comprises a layered structure including first outer lining 261 and first shape correcting member 271. First outer lining 261 may provide an outer covering or liner for first shape correcting member 271. In some cases, first outer lining 261 may be used to hold first shape correcting member 271 in place within upper 222. In other embodiments, however, first shape correcting portion 250 could have any other structure. In another embodiment, for example, first shape correcting member 271 could be disposed on an external surface of upper 222. In still other embodiments, first shape correcting member 271 could be disposed between an interior lining and an exterior lining of upper 222.

In a similar manner, in the current embodiment, second shape correcting portion 252 may comprise a layered structure including second outer lining 262 and second shape correcting member 272. Second outer lining 262 may provide an outer covering or liner for second shape correcting member 272. In some cases, second outer lining 262 may be used to hold second shape correcting member 272 in place within upper 222. In other embodiments, however, second shape correcting portion 252 could have any other structure. In another embodiment, for example, second shape correcting member 272 could be disposed on an external surface of upper 222. In still other embodiments, second shape correcting member 272 could be disposed between an outer lining and an inner lining of upper 222.

Generally, a shape correcting member may be configured in various manners to receive bony protrusions of a foot. In some embodiments, an inner surface of a shape correcting member may include a pre-formed cavity to receive a bony protrusion of a foot. In some cases, a shape correcting member may include a plurality of pre-formed cavities to receive more than one bony protrusion of a foot. In other embodiments, a shape correcting member may include a hole configured to receive a bony protrusion of a foot.

First shape correcting member 271 may be configured to smooth out the shape of first portion 292 of foot 290. In particular, first portion 292 is a medial side of the midfoot that is irregular. First shape correcting member 271 may include inner surface 281 that is contoured to first portion 292 of foot 290. In addition, first shape correcting member 271 may include outer surface 282 that is substantially smooth. This arrangement provides medial side 18 of upper 222 with a substantially smooth surface in the region adjacent to first portion 292 of foot 290.

Second shape correcting member 272 may be configured to smooth out the shape of second portion 294 of foot 290. In particular, second portion 294 is a medial side of foot 290 that may correspond to the navicular bone, which may create bony protrusion 295 of foot 290. Second shape correcting member 272 may include central hole 274 that is configured to receive bony protrusion 295. In addition, second shape correcting member 272 may include outer surface 284 that is substantially smooth. This arrangement provides medial side 18 of upper 222 with a substantially smooth surface in the region adjacent to second portion 294 of foot 290.

Generally, shape correcting members can be configured with any shapes. In some cases, a shape correcting member may be configured with various shapes to present a smooth surface in an area adjacent to a bony protrusion of a foot. Shapes for a shape correcting member include, but are not limited to: circular shapes, ring-like shapes, square shapes, rectangular shapes, elliptical shapes, triangular shapes, regular shapes, irregular shapes as well as other types of shapes. In some embodiments, a shape correcting member may be configured with a size and shape to receive more than one bony protrusion of a foot. In other embodiments, a shape correcting member may be configured with a size and shape to receive one bony protrusion of a foot.

In different embodiments, a shape correcting member may be associated with an article in various manners. A shape correcting member may be attached to an article in any manner known in the art, including, but not limited to: hook and loop type fasteners, adhesives, stitching, as well as other manners known in the art. In some other embodiments, a shape correcting member could be integrally formed with an upper. For example, in another embodiment, an interior wall of an upper could be shaped to conform to the irregular geometry of the adjacent portion of the foot.

In some embodiments, a shape correcting member may be attached to an article during a manufacturing process. In other embodiments, however, a shape correcting member may be attached to an article post-manufacturing. For example, after a customer purchases an article, a customer may attach a shape correcting member to the article. In some cases, the shape correcting member may be purchased separately from the article. This arrangement allows a wearer to apply a shape correcting member to any article of footwear.

In some embodiments, first shape correcting portion 250 and second shape correcting portion 252 may be used to facilitate kicking a ball. In particular, first shape correcting portion 250 and second shape correcting portion 252 may provide substantially smooth outer surfaces for kicking a ball on medial side 18 of article 202. This arrangement can increase user control of a ball by reducing undesired ball trajectories that may occur when a ball strikes an irregular surface caused by a bony protrusion.

Figure 3:
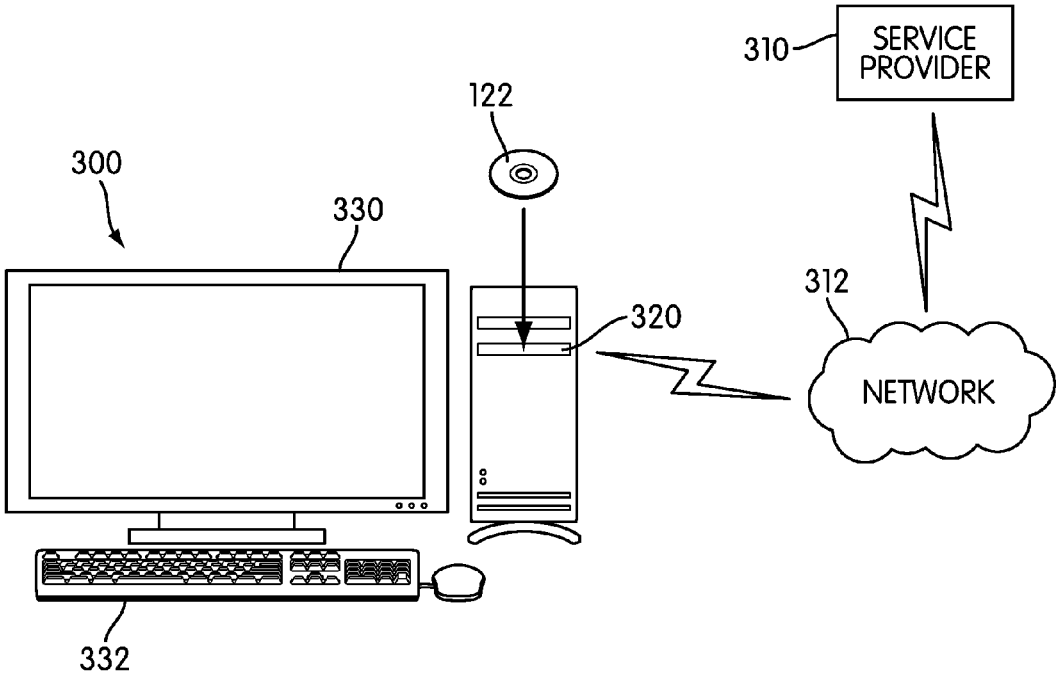
FIG. 3 a schematic view of an embodiment of a computing device that may be used for viewing a set of training instructions.

FIG. 3 illustrates a schematic view of an embodiment of computing device 300. Computing device 300 may be any type of computer, including either a desktop or a laptop computer. In other embodiments, computing device 300 may be any type of device that includes a display and a processor. In some cases, computing device 300 may also include provisions for transmitting and receiving information from a remote network. Examples of such devices include, but are not limited to: PDA's, cell phones, as well as other types of devices.

Computing device 300 can include display device 330 for viewing training instructions. In some cases, computing device 300 can also include input devices 332. In this case, input devices 332 may comprise a keyboard and a mouse.

Computing device 300 may be used to access training instructions stored on electronic media of some kind. For example, in the current embodiment, computing device 300 could be used to access training instructions that may be stored in removable media 122. In this case, computing device 300 may include media drive 320. In addition, computing device 300 may be used to access training instructions that may be stored on other types of media including memory cards, flash drives, as well as any other electronic media device that is capable of being read by a computing device.

In some embodiments, training instructions may be stored at service provider 310. Service provider 310 may be any remote system capable of storing training instructions. In some cases, service provider 310 could comprise one or more servers. In addition, in some cases, training instructions could be stored in the form of content for a website that is hosted by, or in association with, service provider 310. With this arrangement, a user could download training instructions from the website.

Computing device 300 may be configured to access service provider 310 using network 312. Generally, network 312 may be a system allowing for the exchange of information between computing device 300 and service provider 310. Examples of such networks include, but are not limited to: personal area networks, local area networks, wide area networks, client-server networks, peer-to-peer networks, as well as other types of networks. Additionally, the network may support wired transmissions, wireless transmissions, or both wired and wireless transmissions. In some embodiments, network 312 may be a packet-switched communications system. In an exemplary embodiment, network 312 may be the Internet.

Figure 4:
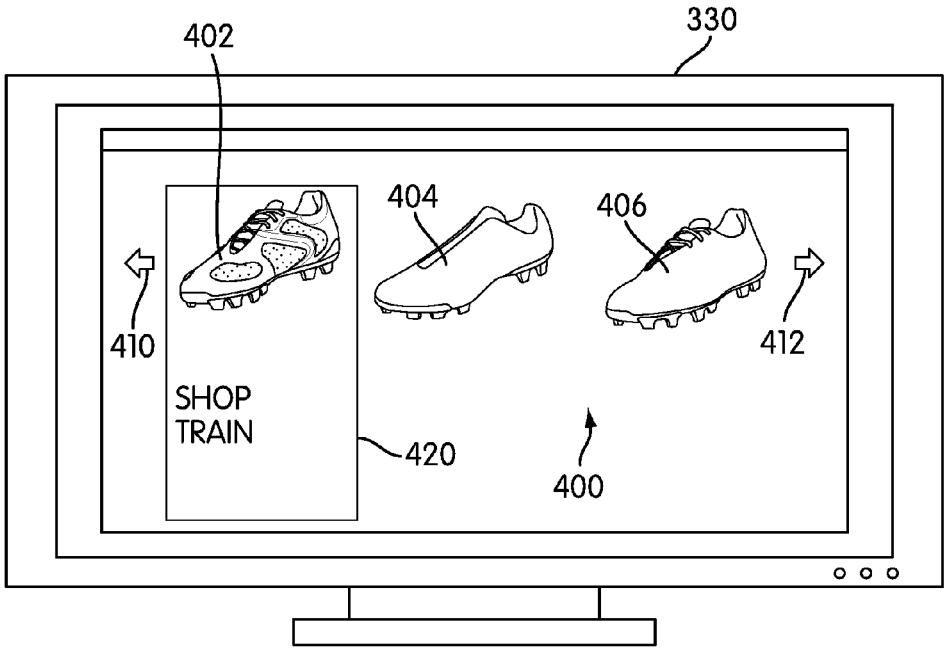
FIG. 4 is a schematic view of an embodiment of a website for viewing a set of training instructions.
Figure 5:
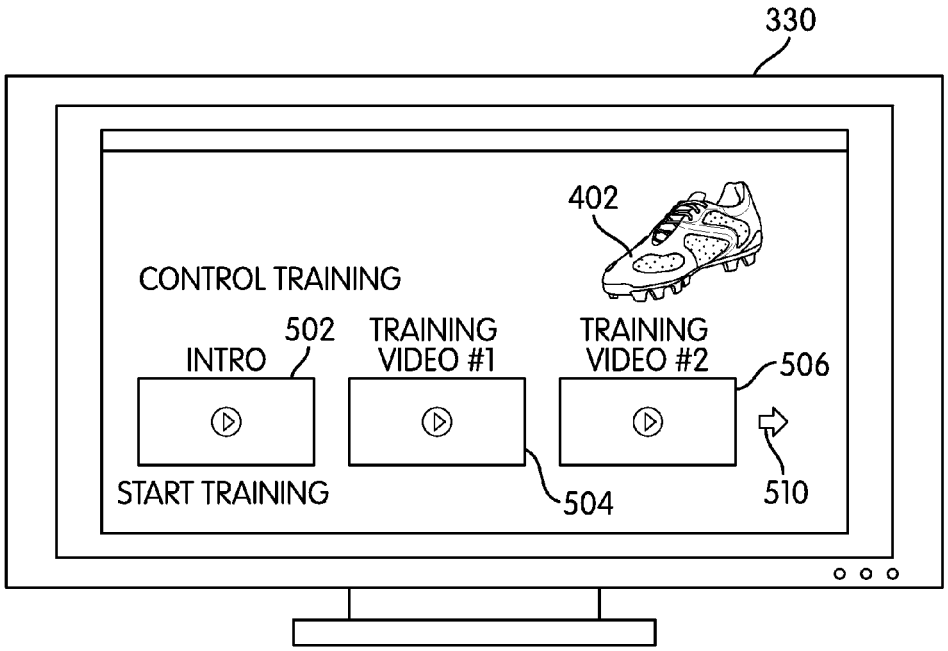
FIG. 5 is a schematic view of an embodiment of a website for viewing a set of training instructions.

FIGS. 4 and 5 illustrate schematic views of an embodiment of a website that provides access to one or more sets of training instructions. It will be understood that the current embodiment is only intended to be exemplary. In other embodiments, a web site configured to provide access to one or more sets of training instructions could have any other layout and/or design. Furthermore, in other embodiments, a user could access training instructions through any other type of interface including various types of software interfaces.

Referring to FIG. 4, in some cases, upon visiting a website a user may be prompted to select a particular article of footwear. In the current embodiment, a user has the option of selecting one of three different types of footwear from footwear menu 400. In particular, a user can choose from first article 402, second article 404 and third article 406. In some cases, first article 402, second article 404 and third article 406 may comprise substantially different kinds of footwear. In other cases, first article 402, second article 404 and third article 406 may comprise similar kinds of footwear. In an exemplary embodiment, first article 402, second article 404 and third article 406 may each be articles with different features that help enhance the performance of a user in different skill areas. For example, in some cases, first article 402 could be an article of footwear that helps enhance ball control for a user. First article 402 could be used with sports such as soccer. In other cases, first article 402 could be used with other sports that require a user to control a ball with a foot. In one embodiment, first article 402 could be substantially similar to first article of footwear 202 that is discussed above. In particular, first article 402 could include one or more shape correcting members that facilitate maintaining a relatively straight trajectory for a ball.

In addition, in some cases, second article 404 could be an article of footwear that helps enhance the accuracy of a kick. Furthermore, in some cases, third article 406 could be an article of footwear that helps enhance the speed of a user on a playing surface. Although three articles of footwear are illustrated in the current embodiment, other embodiments could include any other number of footwear. In some cases, a user may choose to view other footwear options by pressing on first menu cursor 410 or second menu cursor 412. This allows a user to scroll through various footwear options.

In some embodiments, each type of footwear that is associated with a predetermined skill set (control, accuracy and speed, for example) may be associated with a particular set of training instructions that are configured to train an athlete in developing the associated skill set. For example, a user could be provided with training instructions for developing ball control using articles of footwear with shape correcting members. Likewise, a user could be provided with training instructions for developing kicking accuracy using articles of footwear including features intended to enhance kicking accuracy. Still further, a user could be provided with training instructions for developing speed using articles of footwear intended to enhance the speed of a user.

In some cases, upon selecting an article of footwear from footwear menu 400, a user may be prompted with first drop down menu 420 that includes options to purchase the selected footwear or train using the selected footwear. To obtain access to one or more sets of training instructions, a user may select "train" from drop down menu 420. At this point, a user may be prompted with a set of training instructions in the form of training videos, as seen in FIG. 5. In this case, a user may be prompted to select introduction video 502, training video 504 or training video 506. In addition, a user may select additional training videos by clicking on menu cursor 510.

Generally, training videos could be organized in any manner. In some cases, training videos may be organized by content or type. In other cases training videos may be organized in terms of a timeline for a user to progress from one training video to another. For example, in some cases, training videos could be organized in terms of a weekly progression that has a user viewing different videos, or different combinations of videos, each week. In still other cases, training videos could be organized in any other manner.

Although the current embodiment uses sets of training instructions in the form of training videos, in other embodiments sets of training instructions could take any other format. For example, in other cases, a set of training instructions could be provided on a website as a set of written instructions with diagrams and/or pictures of some kind. In still other cases, a set of training instructions could be provided on a website as an audio file that can be listened to for audibly giving the user instructions. Moreover, in still other embodiments, a set of training instructions could be provided on a website in multiple different formats including videos, audio files, written instructions and/or pictures.

FIGS. 6 through 9 illustrate schematic views of an embodiment of a method of providing training instructions in the form of a training video. In particular, FIGS. 6 through 9 illustrate an embodiment of a training drill that may be used to teach an athlete to control a ball using an article of footwear including a shape correcting member. It will be understood that the current embodiment is only intended to be exemplary of one type of drill that could be used to train an athlete. In other embodiments, other types of drills including training instructions could be used.

In the current embodiment, first athlete 602 and second athlete 604 may be provided with articles of footwear. In this case, second athlete 604 is wearing first article of footwear 202 and second article of footwear 204, each of which include shape correcting portions. In some cases, first athlete 602 may also be wearing substantially similar footwear.

Figure 6:
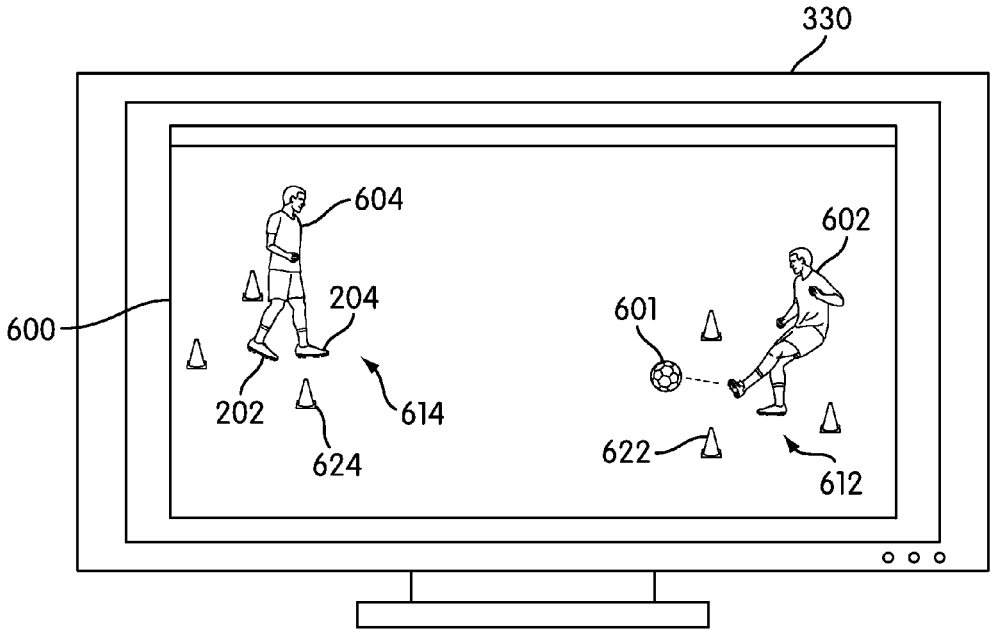
FIG. 6 is a schematic view of an embodiment of a training video for training an athlete to use an article of footwear with a shape correcting member.

Referring to FIG. 6, training video 600 may direct first athlete 602 and second athlete 604 to stand within first control zone 612 and second control zone 614, respectively. The term control zone, as used throughout this detailed description and in the claims refers to any region having a predetermined boundary that may be used in training an athlete to control a ball. First control zone 612 may be a substantially triangular area defined by first set of cones 622. Likewise, second control zone 614 may be a substantially triangular area defined by second set of cones 624. In different embodiments, the shape and/or sizes of first control zone 612 and second control zone 614 could vary. Information about the size of each control zone and the spacing between each control zone could be provided in training video 600 or a separate set of instructions that may be used with training video 600. In one embodiment, for example, first control zone 612 and second control zone 614 could comprise triangles with widths of approximately 8 meters and lengths of approximately 3 meters. In addition, the rearward portions of first control zone 612 and second control zone 614 could be separated by approximately 20 meters.

Figure 7:
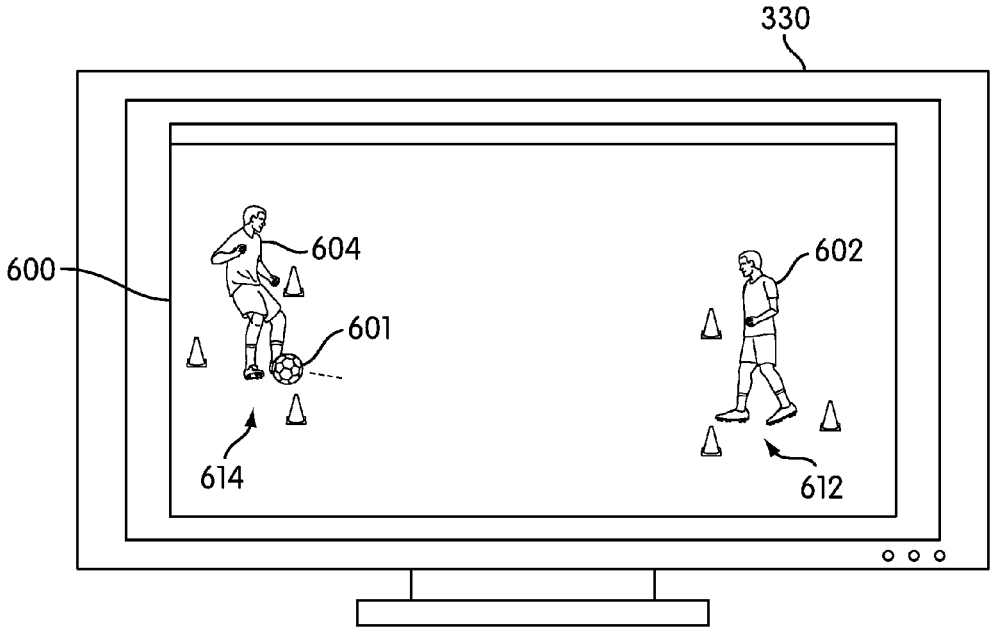
FIG. 7 is a schematic view of an embodiment of a training video for training an athlete to use an article of footwear with a shape correcting member.
Figure 8:
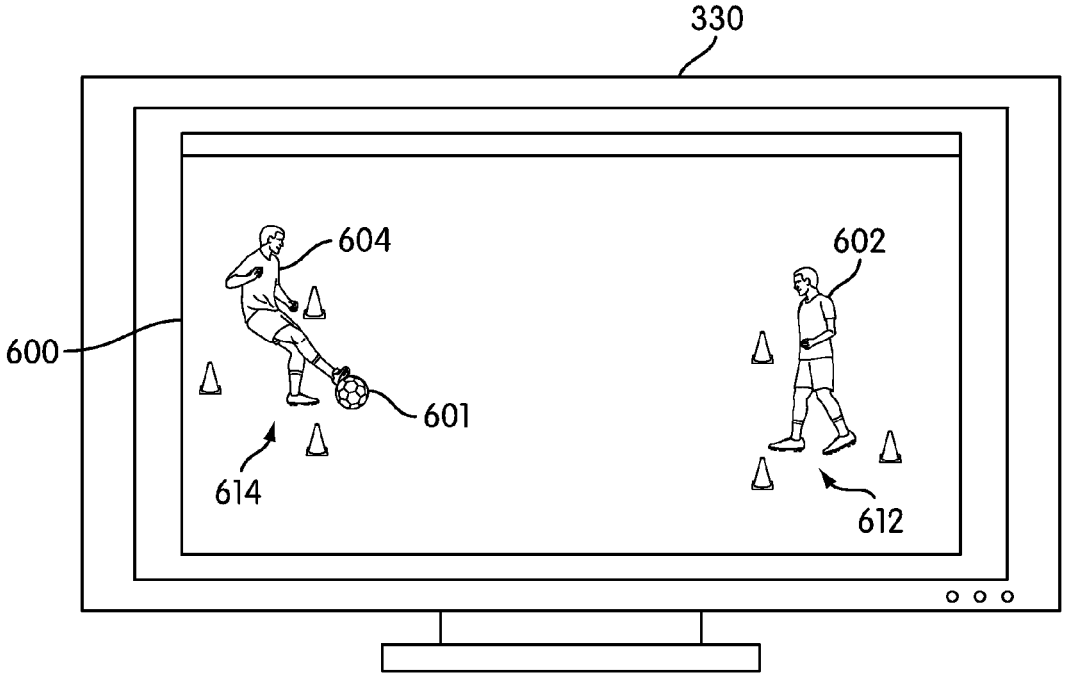
FIG. 8 is a schematic view of an embodiment of a training video for training an athlete to use an article of footwear with a shape correcting member.

Initially, training video 600 may instruct first athlete 602 to pass ball 601 to second athlete 604. Next, as seen in FIG. 7, training video 600 may instruct second athlete 604 to receive ball 601 from first athlete 602. In some cases, training video 600 may instruct second athlete 604 to receive ball 601 without allowing ball 601 to leave second control zone. In other words, training video 600 could instruct second athlete 604 to maintain ball 601 within second control zone 614. Next, as seen in FIG. 8, training video 600 could instruct second athlete 604 to trap ball 601.

Figure 9:
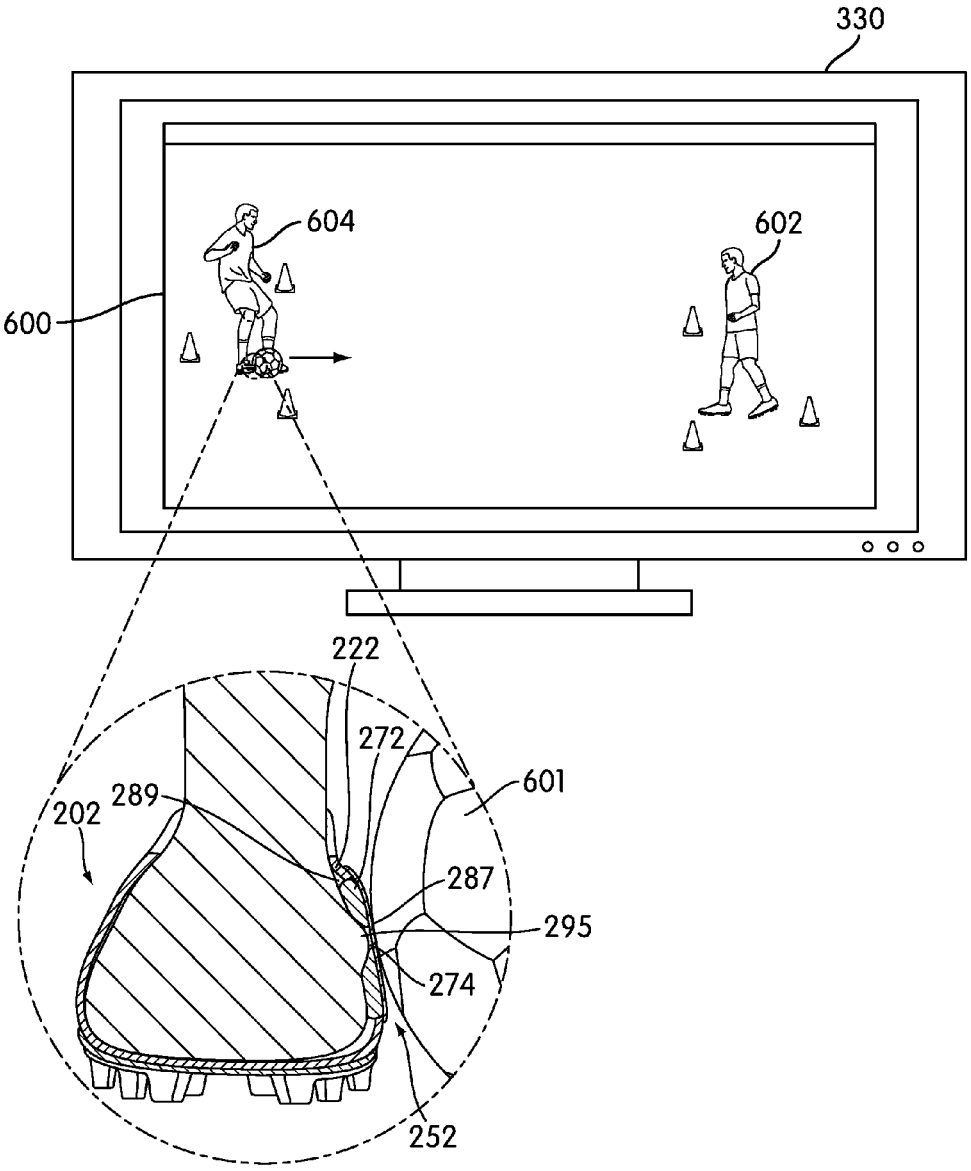
FIG. 9 is a schematic view of an embodiment of a training video for training an athlete to use an article of footwear with a shape correcting member.

Referring now to FIG. 9, training video 600 could instruct second athlete 604 to pass ball 601 back to first athlete 602. In particular, training video 600 may instruct second athlete 604 to pass ball 601 by contacting the ball with second shape correcting portion 252. As previously discussed, second shape correcting portion 252 includes second shape correcting member 272 that is disposed within interior portion 289 of upper 222. Furthermore, second shape correcting member 272 includes central hole 274 that is configured to receive bony protrusion 295. With this arrangement, second shape correcting member 272 presents flat surface 287 for second shape correcting portion 252. This further provides a substantially straight trajectory for ball 601 as second athlete 604 passes ball 601 back to first athlete 602.

As mentioned, the current embodiment is only intended to be exemplary. In other embodiments, the control zones could be modified to have different shapes, sizes and locations. For example, in another embodiment, a training video could provide instructions for a pair of athletes to stand inside of square control zones defined by four cones per control zone. The control zones could be approximately 3 meters on each size and separated by approximately 10 meters. The athletes could then be directed to perform similar types of passing and receiving maneuvers using shape correcting portions of their footwear, while maintaining a ball within the control zones.

In still other embodiments, additional athletes located within additional control zones could be incorporated into a drill. In still further embodiments, a training video may provide training instructions in which an athlete works alone in a single control zone. The athlete could be directed to juggle the ball and maintain the ball within the control zone at all times. In some cases, the athlete could be instructed to shoot at a target, such as a goal, following a predetermined number of touches with the ball.

In addition to providing visual instructions, a training system may be configured to provide additional training information. For example, in some cases, a training system could provide information related to the number of repetitions of a drill that is shown in a training video. In an exemplary embodiment, an athlete may be provided with a worksheet that indicates the desired number of repetitions of a drill for a particular day of a training schedule.

Figure 10:
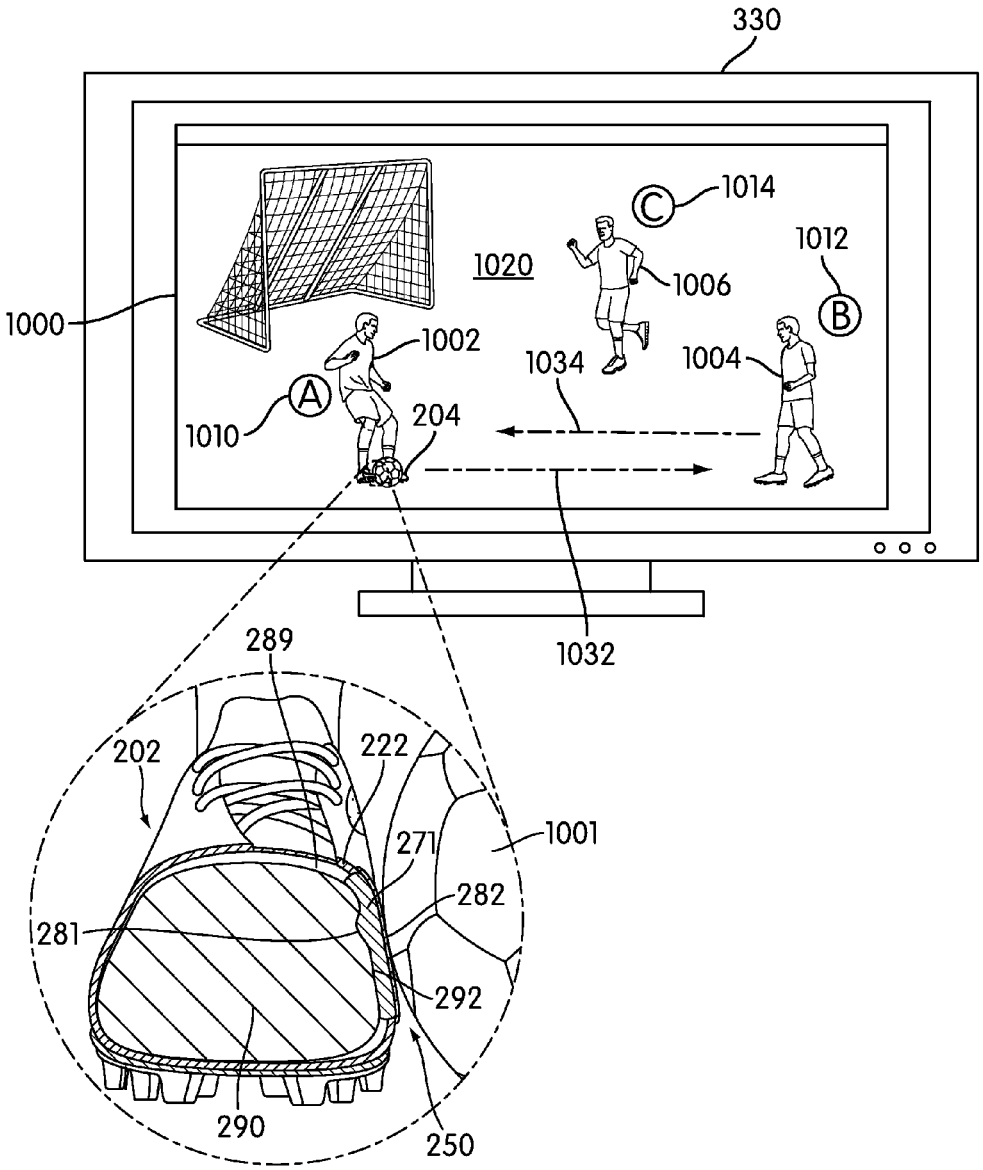
FIG. 10 is a schematic view of an embodiment of a training video for training an athlete to use an article of footwear with a shape correcting member.
Figure 11:
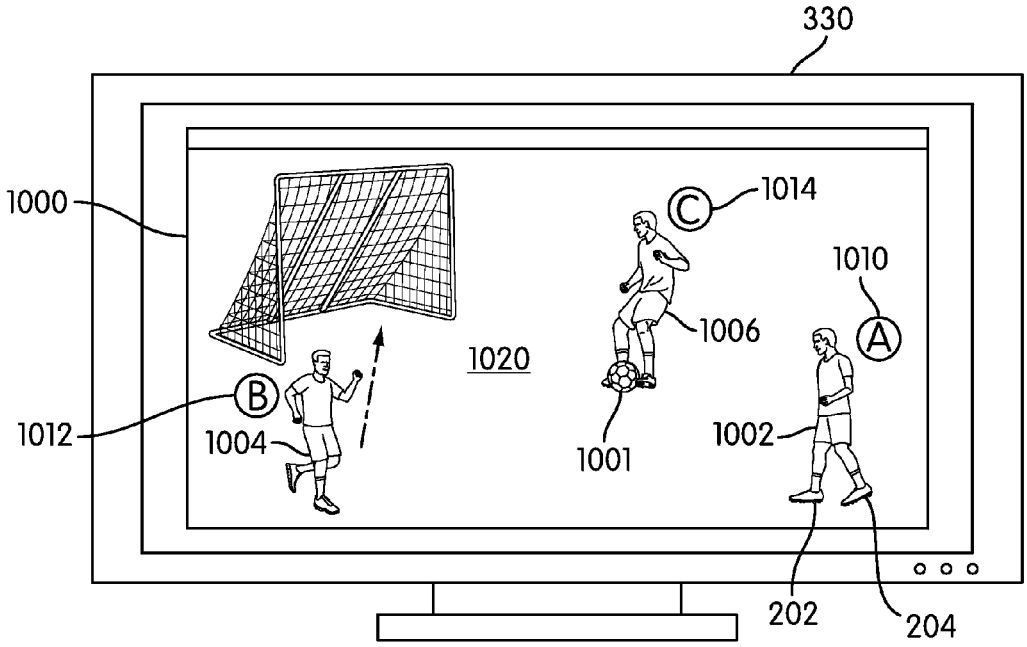
FIG. 11 is a schematic view of an embodiment of a training video for training an athlete to use an article of footwear with a shape correcting member.

FIGS. 10 and 11 illustrate schematic views of another embodiment of a method of providing a set of training instructions to an athlete in the form of a training video. Referring to FIG. 10, training video 1000 shows three athletes on a playing field, including first athlete 1002, second athlete 1004 and third athlete 1006. In the current embodiment, first athlete 1002 is wearing first article of footwear 202 and second article of footwear 204, which each include shape correcting portions. In some cases, second athlete 1004 and third athlete 1006 may also be wearing substantially similar articles of footwear with shape correcting portions.

In some embodiments, a training video can include various indicators. For example, in the current embodiment, training video 1000 includes first indicator 1010, second indicator 1012 and third indicator 1014 for visually indicating first athlete 1002, second athlete 1004 and third athlete 1006, respectively. This arrangement may help provide clarity in identifying different athletes as the athletes move across playing field 1020. In other embodiments, any other indicators could be used for facilitating an explanation of the training instructions.

Referring to FIGS. 10 and 11, training video 1000 may instruct first athlete 1002, second athlete 1004 and third athlete 1006 to start at predetermined positions on playing field 1020. In some cases, these predetermined positions may be positions that are relative to a goal post or some other feature on playing field 1020 such as one or more cones. Training video 1000 may direct first athlete 1002, second athlete 1004 and third athlete 1006 to move to different positions. In some embodiments, training video 1000 may direct first athlete 1002 and second athlete 1004 to move along first predetermined path 1032 and second predetermined path 1034, respectively. The term "predetermined path" as used throughout this detailed description and in the claims refers to any general direction or trajectory that an athlete may take during a training exercise. Training video 1000 can instruct athletes to move on predetermined paths in various manners. In some cases, training video 1000 may instruct an athlete to move from an initial predetermined position towards a second predetermined position. These predetermined positions can be marked using cones or any other means for marking positions. In other cases, training video 1000 may instruct an athlete to move generally in the direction of another athlete, or in the general direction of a goal post.

As each athlete moves to different positions on the playing field, ball 1001 may be passed between the athletes. For example, in the current embodiment first athlete 1002 may initially pass ball 1001 to second athlete 1004. In particular, training video 1000 may instruct first athlete 1002 to pass ball 1001 using first shape correcting portion 250 of first article of footwear 202. As previously discussed, first shape correcting portion 250 may include first shape correcting member 271 that is disposed in interior portion 289 of upper 222. Moreover, first shape correcting member 271 includes inner surface 281 that conforms to the shape of foot 290 at first portion 292. First shape correcting member 271 also includes smooth outer surface 282. Therefore, as first shape correcting portion 250 contacts ball 1001, first shape correcting member 271 provides a substantially smooth surface for first shape correcting portion 250 of upper 222. This arrangement allows ball 1001 to be kicked in a substantially straight trajectory.

Training video 1000 may further instruct each athlete along various paths on playing field 1020 so that each athlete is provided a chance to pass and receive ball 1001 while moving in order to enhance the ability of an athlete to control the ball in various situations. In some cases, this drill could end with second athlete 1004 taking a shot on goal.

Figure 12:
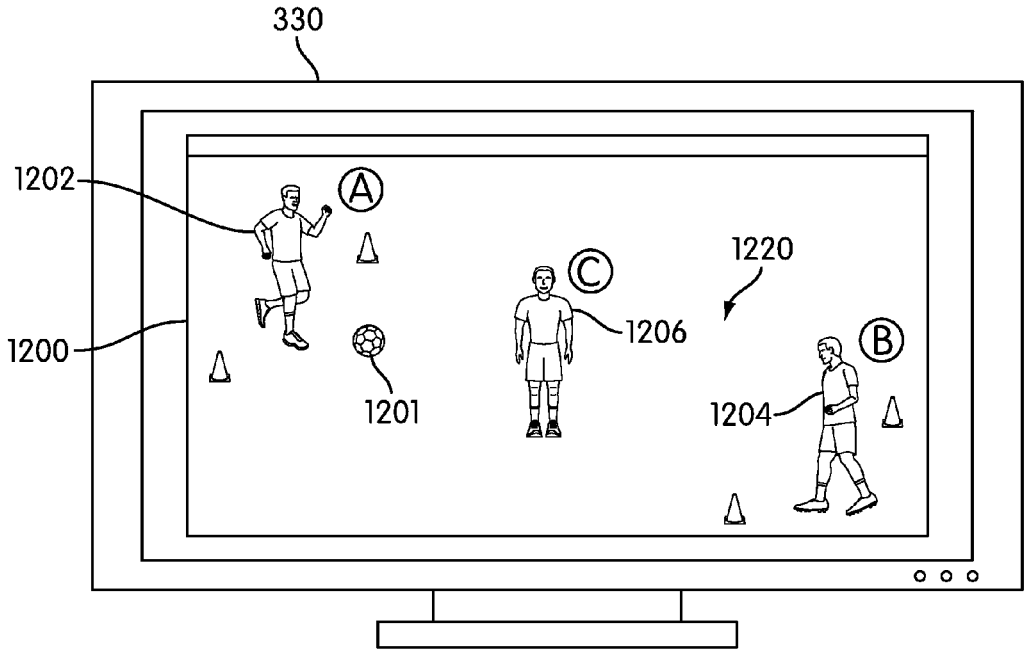
FIG. 12 is a schematic view of an embodiment of a training video for training an athlete to use an article of footwear with a shape correcting member.

FIG. 12 illustrates a schematic view of another embodiment of a method of providing training instructions to an athlete in the form of a training video. In this case, training video 1200 shows first athlete 1202, second athlete 1204 and third athlete 1206. Third athlete 1206 may be disposed between first athlete 1202 and second athlete 1204. In this case, first athlete 1202 and second athlete 1204 may be instructed to pass ball 1201 back and forth, while maintaining ball 1201 within control area 1220. Third athlete 1206 is instructed to attempt to disrupt the passes between first athlete 1202 and second athlete 1204. This drill may help each athlete improve control over a ball.

The previous embodiments are intended to be exemplary of the different types of training instructions that can be provided to athletes for the purposes of improving ball control using articles of footwear with shape correcting members. In still other embodiments, other types of drills could be used and shown in training videos. For example, in another embodiment, two athletes could be instructed to play a game of football or soccer tennis, in which a soccer ball is kicked over a net or divider in a manner similar to the hitting of a tennis ball over a net in tennis. Moreover, each of these different types of training drills or training videos may incorporate training instructions that are intended to teach an athlete to perform controlled kicks using an article of footwear with a shape correcting portion.

In some embodiments, a training system may be implemented using a mobile device. In some cases, training instructions can be provided on a web browser operating on the mobile device. In other cases, training instructions can be provided using one or more applications that are configured to run on the mobile device. In still other cases, training instructions can be provided using any combination of web browsers and dedicated applications running on a mobile device.

Figure 13:
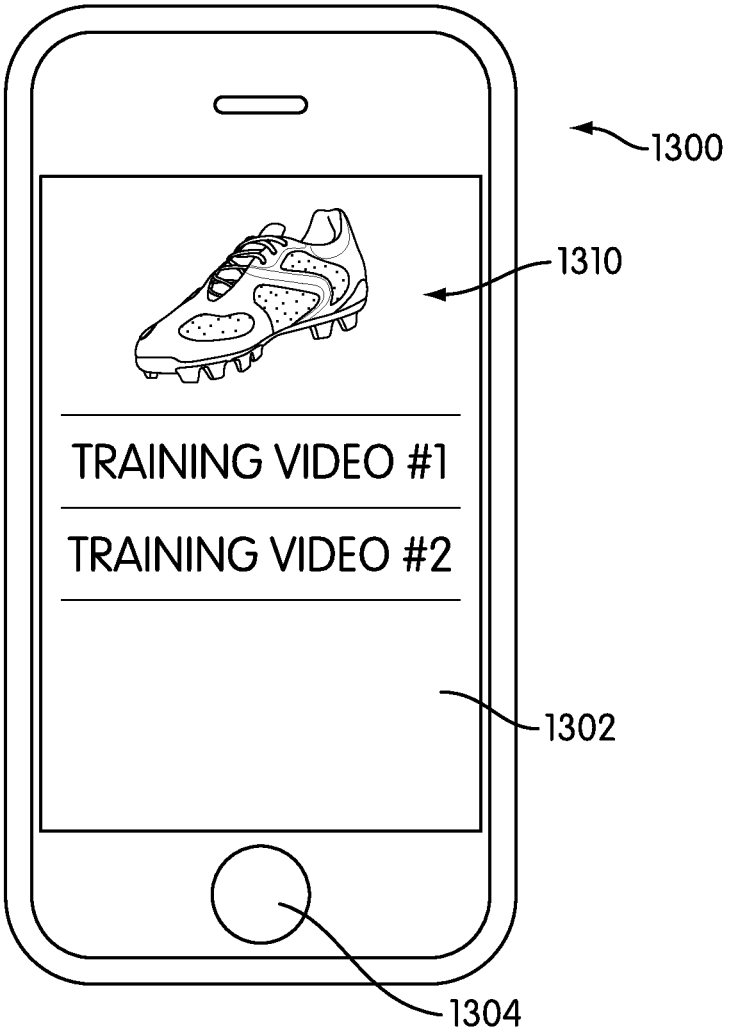
FIG. 13 is a schematic view of a portable computing device that may be used for viewing a training video.

FIG. 13 illustrates a schematic view of an embodiment of a training system that utilizes one or more features of mobile device 1300. Generally, a mobile device could be any device that is portable and that may be used by an athlete or user to obtain training instructions. Examples of different mobile devices include, but are not limited to: mobile phones, digital music players, portable digital assistants (PDAs), portable gaming machines, ultraportable laptops as well as any other kinds of mobile devices. In the exemplary embodiment, mobile device 1300 may be an iPhone or iPod manufactured by Apple Computer, Inc.

Mobile device 1300 can be configured with display screen 1302. Also, mobile device 1300 can include input button 1304. Furthermore, in some cases, mobile device 1300 can be configured with a touch-sensitive screen. In other cases, mobile device 1300 can include any other input devices. It will be understood that mobile device 1300 can include various other provisions including speakers, a microphone, ports for syncing and/or powering mobile device 1300, a headphone jack as well as various other provisions which are not visible in FIG. 13.

Mobile device 1300 can be configured to run one or more software applications. In some cases, software applications can be provided on mobile device 1300 at the time of manufacturing. In other cases, software applications can be downloaded from a service provider. In one exemplary embodiment, a user may purchase an application from an online retail store such as iTunes.

Mobile device 1300 may be configured to run training application 1310. In some cases, training application 1310 may be a software application that provides a user with various training videos including any of the videos that are accessible in the website described above. In some cases, upon loading training application 1310, a user may be prompted to select the desired training video.

In some embodiments, a training application may be designed for a particular type of footwear. For example, in the current embodiment, training application 1310 may be designed to provide training instructions for training an athlete to control a ball using articles of footwear with shape correcting portions. In other embodiments, a training application could be configured with training instructions for multiple different kinds of footwear. In such cases, upon loading the training application, a user could be prompted to select the desired type of footwear for training.

Figure 14:
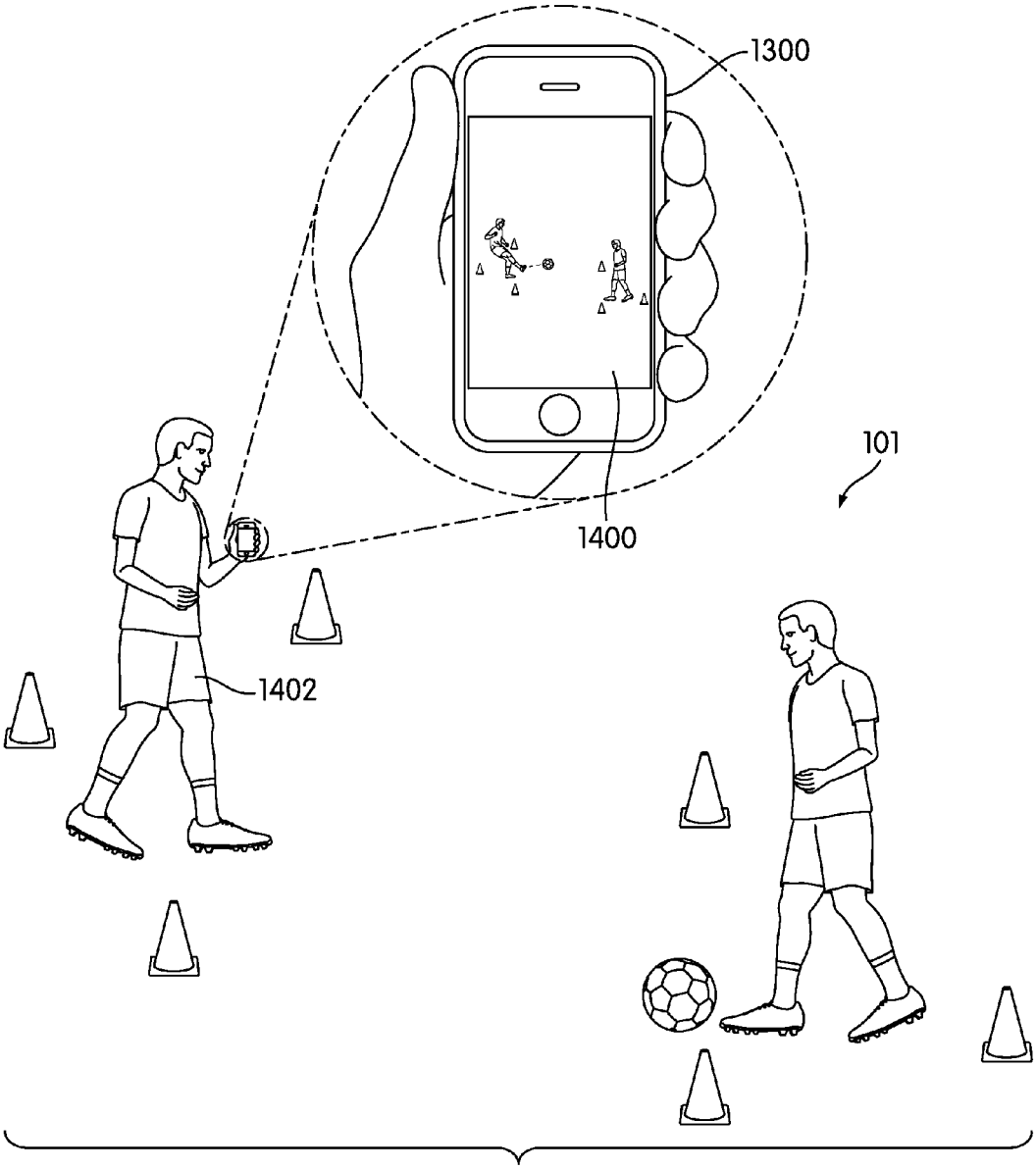
FIG. 14 is a schematic view of an embodiment of an athlete using a portable computing device during training.

FIG. 14 illustrates an embodiment of training system 101 incorporating the use of mobile device 1300. In this case, first athlete 1402 is able to view training video 1400 on mobile device 1300. This allows first athlete 1402 to receive training instructions while participating in a training activity. Although the current embodiment illustrates first athlete 1402 holding mobile device 1300 during a training exercise, in other embodiments first athlete 1402 may not hold mobile device 1300 during the training exercise. With this arrangement, first athlete 1402 is able to receive training instructions in various different situations.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A method of using an article of footwear to train a wearer of the article of footwear, comprising the steps of:

providing information for a user to remotely access one or more sets of training instructions on a website and providing the one or more sets of training instructions to the user via the website;

wherein the one or more sets of training instructions include instructions for the wearer to move along a predetermined path;

wherein the one or more sets of training instructions include instructions for the wearer to pass a ball by contacting the ball with a portion of an upper of the article of footwear including a shape correcting member, the shape correcting member being disposed in an inner portion of the upper and the shape correcting member including a central hole configured to receive a bony protrusion of a foot;

wherein the shape correcting member is disposed on a top portion of the article of footwear and an inner surface of the shape correcting member corresponds with a top portion of a foot;

the article of footwear having a medial side and a lateral side, wherein a lateral direction extends between the medial side and the lateral side; and the inner surface including a plurality of laterally spaced, pre-formed cavities, configured to fit to the contours of the top portion of the foot; and wherein the shape correcting member further includes an outer surface opposite the inner surface, the outer surface being a substantially non-protruding surface having an approximately constant curvature.

2. The method according to claim 1, wherein the training instructions are provided in a written format.

3. The method according to claim 1, wherein the training instructions are provided in a video format.

4. The method according to claim 1, wherein the training instructions are provided in an audible format.

5. The method according to claim 1, wherein the information for the user to remotely access the training instructions is provided in a training kit, the training kit including the article of footwear.

6. The method according to claim 1, wherein the training instructions provide instructions for training multiple athletes simultaneously.

7. A method of using an article of footwear, comprising the steps of:

receiving a training kit including the article of footwear and information regarding a set of training instructions, wherein the set of training instructions include instructions for developing kicking accuracy;

in accordance with the training instructions, maintaining a ball within a control zone, the control zone having predetermined boundaries, and passing the ball outside of the control zone by contacting the ball with a portion of an upper of the article of footwear including a shape correcting member, the shape correcting member including an inner surface associated with a portion of a foot and an outer surface disposed opposite of the inner surface, the inner surface being pre-shaped to fit to an irregular geometry of the portion of the foot;

wherein the shape correcting member is disposed on a top portion of the article of footwear and the inner surface corresponds with a top portion of a foot;

the article of footwear having a medial side and a lateral side, wherein a lateral direction extends between the medial side and the lateral side; and the inner surface including a plurality of laterally spaced, pre-formed cavities, configured to fit to the contours of the top portion of the foot; and wherein the outer surface is a substantially non-protruding surface having an approximately constant curvature.

8. The method according to claim 7, wherein the training kit includes the set of instructions provided on removable media.

9. The method according to claim 7, wherein the training kit includes the set of training instructions provided in an instruction booklet.

10. The method according to claim 7, wherein the information provided in the training kit regarding the set of training instructions includes information for a user to remotely access the set of training instructions on a website.

11. The method according to claim 7, wherein the training instructions are provided in a software application.

12. The method according to claim 7, wherein the training instructions are configured to be accessed on a computer.

13. The method according to claim 7, wherein the training instructions are configured to be accessed on a mobile device.

14. A method of using an article of footwear, comprising the steps of:

receiving training instructions;

moving along a predetermined path, the predetermined path being determined from the training instructions;

passing a ball by contacting the ball with a portion of an upper of the article of footwear including a shape correcting member, the shape correcting member including an inner surface associated with a portion of a foot and an outer surface disposed opposite of the inner surface, the inner surface being pre-shaped to fit to an irregular geometry of the portion of the foot;

wherein the shape correcting member is disposed on a top portion of the article of footwear and the inner surface corresponds with a top portion of a foot;

the article of footwear having a medial side and a lateral side, wherein a lateral direction extends between the medial side and the lateral side; and the inner surface including a plurality of laterally spaced, pre-formed cavities, configured to fit to the contours of the to portion of the foot; and wherein the outer surface is a substantially non-protruding surface having an approximately constant curvature.

15. The method according to claim 14, wherein the training instructions and the article of footwear are received in a training kit.

16. The method according to claim 14, wherein the method includes a step of using a computing device to read digital information related to the training instructions.

17. The method according to claim 14, wherein the method includes a step of receiving the training instructions from a website.

18. The method according to claim 14, wherein the method includes a step of reading an instruction booklet that includes the training instructions.

19. The method according to claim 14, wherein the method includes a step of downloading a training application onto a mobile device, the training application including information about the training instructions.

20. The method according to claim 14, wherein the method includes a step of watching a training video, the training video including information about the training instructions.

21. The method according to claim 7, wherein the outer surface of the shape correcting member is a substantially smooth surface.

22. The method according to claim 14, wherein the outer surface of the shape correcting member is a substantially smooth surface.

23. The method according to claim 7, wherein the upper of the article of footwear includes a tongue, and the shape correcting member is configured as a raised portion of the tongue.

24. The method according to claim 14, wherein the upper of the article of footwear includes a tongue, and the shape correcting member is configured as a raised portion of the tongue.

25. The method according to claim 7, wherein the plurality of laterally spaced, pre-formed cavities are each configured to receive a bony protrusion of the top portion of the foot.

26. The method according to claim 14, wherein the plurality of laterally spaced, pre-formed cavities are each configured to receive a bony protrusion of the top portion of the foot.

27. A training kit, comprising:

a container configured to store at least one article of footwear;

an article of footwear stored within the container;

the article of footwear including a shape correcting member;

the shape correcting member including an inner surface associated with a portion of a foot and an outer surface disposed opposite of the inner surface, the inner surface being pre-shaped to fit to an irregular geometry of the portion of the foot; and information, stored in the container, regarding a set of training instructions;

the set of training instructions including instructions for developing kicking accuracy by instructing a wearer of the article of footwear to kick a ball by contacting the ball with a portion of an upper of the article of footwear including the shape correcting member;

wherein the shape correcting member is disposed on a top portion of the article of footwear and the inner surface corresponds with a top portion of a foot;

the article of footwear having a medial side and a lateral side, wherein a lateral direction extends between the medial side and the lateral side; and the inner surface including a plurality of laterally spaced, pre-formed cavities, configured to fit to the contours of the top portion of the foot; and wherein the outer surface is a substantially non-protruding surface having an approximately constant curvature.

28. The training kit according to claim 27, wherein the training kit includes the set of instructions provided on removable media.

29. The training kit according to claim 27, wherein the training kit includes the set of training instructions provided in an instruction booklet.

30. The training kit according to claim 27, wherein the information provided in the training kit regarding the set of training instructions includes information for a user to remotely access the set of training instructions on a website.

31. The training kit according to claim 27, wherein the training instructions are provided in a software application.

32. The training kit according to claim 27, wherein the training instructions are configured to be accessed on a computer.

33. The training kit according to claim 27, wherein the training instructions are configured to be accessed on a mobile device.

* * * * *